US011561036B1

(12) United States Patent
Vaisman et al.

(10) Patent No.: US 11,561,036 B1
(45) Date of Patent: Jan. 24, 2023

(54) THERMAL MANAGEMENT SYSTEMS

(71) Applicant: Booz Allen Hamilton Inc., McLean, VA (US)

(72) Inventors: Igor Vaisman, Carmel, TN (US); Joshua Peters, Knoxville, TN (US)

(73) Assignee: Booz Allen Hamilton Inc., McLean, VA (US)

( * ) Notice: Subject to any disclaimer, the term of this patent is extended or adjusted under 35 U.S.C. 154(b) by 0 days.

(21) Appl. No.: 17/394,551

(22) Filed: Aug. 5, 2021

Related U.S. Application Data

(63) Continuation of application No. 16/666,992, filed on Oct. 29, 2019, now Pat. No. 11,112,155.

(60) Provisional application No. 62/754,111, filed on Nov. 1, 2018.

(51) Int. Cl.
*F25B 49/02* (2006.01)
*F25B 5/04* (2006.01)
*F25B 41/20* (2021.01)

(52) U.S. Cl.
CPC ..... *F25B 49/02* (2013.01); *F25B 5/04* (2013.01); *F25B 41/20* (2021.01)

(58) Field of Classification Search
CPC .. F25B 49/02; F25B 5/04; F25B 41/20; F25B 19/00; F25B 41/31; F25B 39/028; F25B 49/00; F25B 45/00; F25B 2700/191
See application file for complete search history.

(56) References Cited

U.S. PATENT DOCUMENTS 1,836,318 A 12/1931 Gay
2,083,611 A 6/1937 Marshall
2,180,090 A 11/1939 Mesinger
2,207,729 A 7/1940 Goodman
2,226,797 A 12/1940 Andersson
2,489,514 A 11/1949 Benz
2,526,221 A 10/1950 Goddard
2,785,540 A 3/1957 Biehn
2,885,864 A 5/1959 Benjamin
3,073,380 A 1/1963 Palmason
(Continued)

FOREIGN PATENT DOCUMENTS

WO WO 2013/115156 8/2013

OTHER PUBLICATIONS

U.S. Appl. No. 16/448,196, filed Jun. 21, 2019, Vaisman et al.
(Continued)

*Primary Examiner* — Kun Kai Ma
(74) *Attorney, Agent, or Firm* — Fish & Richardson P.C.

(57) ABSTRACT

A thermal management system includes an open circuit refrigeration circuit that has a refrigerant fluid flow path, with the refrigerant fluid flow path including a receiver configured to store a refrigerant fluid, a first control device configured to receive refrigerant from the receiver, a liquid separator, and an evaporator configured to extract heat from a heat load that contacts the evaporator, with the evaporator coupled to the first control device and the liquid separator. The system includes a pump having an inlet and an outlet, with the outlet of the pump coupled to the liquid side outlet of the liquid separator and a second control device that is coupled to an exhaust line, that is coupled to the vapor side outlet of the liquid separator through the second control device. In operation, the evaporator in the open circuit refrigeration circuit would be coupled to a heat load.

35 Claims, 19 Drawing Sheets

(56) References Cited

U.S. PATENT DOCUMENTS 3,300,996 A 1/1967 Atwood
3,468,421 A 9/1969 Hazel et al.
3,542,338 A 11/1970 Scaramucci
3,600,904 A 8/1971 Tilney
3,685,310 A * 8/1972 Fischer ..... F25B 19/00 62/48.1
3,789,583 A 2/1974 Smith
3,866,427 A 2/1975 Rothmayer et al.
3,882,689 A 5/1975 Rogers
4,015,439 A 4/1977 Stern
4,016,657 A 4/1977 Passey
4,054,433 A 10/1977 Buffiere et al.
4,123,919 A 11/1978 Fehlhaber
4,151,724 A 5/1979 Garland
4,169,361 A 10/1979 Baldus
4,275,570 A 6/1981 Szymaszek et al.
4,295,282 A * 10/1981 Fox ..... F26B 25/006 34/76
4,313,305 A 2/1982 Egosi
4,323,109 A 4/1982 Jaster
4,352,272 A 10/1982 Taplay
4,419,865 A 12/1983 Szymaszek
4,438,635 A 3/1984 McCoy, Jr.
4,466,253 A 8/1984 Jaster
4,539,816 A * 9/1985 Fox ..... B01D 53/002 62/402
4,870,830 A 10/1989 Hohenwarter et al.
4,969,495 A 11/1990 Grant
5,088,304 A 2/1992 Schlichtig
5,094,277 A 3/1992 Grant
5,127,230 A * 7/1992 Neeser ..... F17C 13/025 62/7
5,174,126 A 12/1992 Cameron
5,176,008 A 1/1993 Van Steenburgh, Jr.
5,187,953 A * 2/1993 Mount ..... F25B 43/04 62/195
5,191,776 A 3/1993 Severance et al.
5,245,840 A 9/1993 Van Steenburgh, Jr.
5,297,392 A 3/1994 Takata et al.
5,325,894 A 7/1994 Kooy et al.
5,353,603 A * 10/1994 Outlaw ..... F25B 45/00 62/149
5,360,139 A 11/1994 Goode
5,429,179 A 7/1995 Klausing
5,471,848 A 12/1995 Major et al.
5,513,961 A 5/1996 Engdahl et al.
5,690,743 A 11/1997 Murakami et al.
5,762,119 A 6/1998 Platz et al.
5,974,812 A 11/1999 Kátai et al.
6,044,647 A 4/2000 Drube et al.
6,076,360 A 6/2000 Viegas et al.
6,112,532 A 9/2000 Bakken
6,161,386 A * 12/2000 Lokhandwala ..... F02C 3/22 60/671
6,230,518 B1 5/2001 Hahn et al.
6,314,749 B1 11/2001 Van Steenburgh, Jr.
6,336,333 B1 1/2002 Lindgren
6,354,088 B1 3/2002 Emmer et al.
6,381,972 B1 * 5/2002 Cotter ..... F25D 23/006 62/126
6,427,453 B1 8/2002 Holtzapple et al.
6,474,101 B1 11/2002 Quine et al.
6,564,578 B1 5/2003 Fischer-Calderon
6,684,658 B2 2/2004 Holtzapple et al.
6,964,168 B1 11/2005 Pierson et al.
7,287,581 B2 10/2007 Ziehr et al.
7,377,126 B2 5/2008 Gorbounov et al.
7,497,180 B2 * 3/2009 Karlsson ..... B63J 99/00 62/50.3
7,891,197 B2 2/2011 Winter
7,987,685 B2 8/2011 Oshitani et al.
9,016,413 B2 4/2015 Ikeya
9,267,645 B2 2/2016 Mackey
9,331,349 B2 5/2016 Yamazaki et al.
9,791,221 B1 10/2017 Litch
9,887,079 B2 2/2018 Sugawara et al.
9,987,904 B2 6/2018 Koyama et al.
10,126,022 B1 11/2018 Cooper
10,612,821 B1 4/2020 Fernando
10,907,869 B2 2/2021 Hagh et al.
11,112,155 B1 9/2021 Vaisman et al.
11,168,925 B1 11/2021 Vaisman et al.
11,231,209 B2 1/2022 Cavalleri et al.
11,293,673 B1 4/2022 Vaisman et al.
11,313,594 B1 4/2022 Davis et al.
2002/0088243 A1 7/2002 Holtzapple et al.
2002/0148225 A1 10/2002 Lewis
2002/0157407 A1 10/2002 Weng
2004/0123624 A1 7/2004 Ohta et al.
2004/0154328 A1 8/2004 Holtzapple et al.
2005/0060970 A1 3/2005 Polderman
2005/0201429 A1 9/2005 Rice et al.
2006/0207285 A1 9/2006 Oshitani et al.
2006/0218964 A1 10/2006 Saito et al.
2006/0222522 A1 10/2006 Holtzapple
2006/0254308 A1 11/2006 Yokoyama et al.
2007/0000262 A1 1/2007 Ikegami et al.
2007/0007879 A1 1/2007 Bergman, Jr. et al.
2007/0039349 A1 2/2007 Yamada et al.
2007/0180852 A1 8/2007 Sugiura et al.
2007/0274858 A1 * 11/2007 Childers ..... A61L 2/208 422/62
2008/0087040 A1 4/2008 Oshitani et al.
2008/0092559 A1 4/2008 Williams et al.
2008/0148754 A1 6/2008 Snytsar
2008/0196446 A1 8/2008 Nakamura et al.
2009/0110986 A1 4/2009 Choi et al.
2009/0158727 A1 6/2009 Bitter et al.
2009/0211298 A1 8/2009 Saul
2009/0219960 A1 9/2009 Uberna et al.
2009/0228152 A1 9/2009 Anderson et al.
2010/0098525 A1 4/2010 Guelich
2010/0154395 A1 * 6/2010 Frick ..... F22B 1/1807 123/142.5 R
2011/0114284 A1 5/2011 Siegenthaler
2011/0185712 A1 8/2011 Burns et al.
2011/0185726 A1 8/2011 Burns et al.
2011/0209771 A1 9/2011 Yung et al.
2011/0314805 A1 12/2011 Seale et al.
2012/0167601 A1 7/2012 Cogswell et al.
2012/0204583 A1 8/2012 Liu
2012/0312379 A1 12/2012 Gielda et al.
2013/0000341 A1 1/2013 De Piero et al.
2013/0025305 A1 1/2013 Higashiiue et al.
2013/0104593 A1 5/2013 Occhipinti
2013/0111934 A1 5/2013 Wang et al.
2013/0125569 A1 5/2013 Verma et al.
2013/0340622 A1 12/2013 Marty et al.
2014/0075984 A1 * 3/2014 Sugawara ..... B01D 53/0438 62/606
2014/0165633 A1 6/2014 De Piero et al.
2014/0166238 A1 6/2014 Sandu
2014/0260341 A1 9/2014 Vaisman et al.
2014/0331699 A1 11/2014 Higashiiue
2014/0342260 A1 11/2014 Koyama et al.
2014/0345318 A1 11/2014 Nagano et al.
2014/0356748 A1 12/2014 Yamazaki et al.
2014/0366563 A1 * 12/2014 Vaisman ..... B64D 13/06 62/87
2015/0059379 A1 3/2015 Ootani et al.
2015/0184898 A1 * 7/2015 Vaisman ..... F25B 41/00 62/115
2015/0260435 A1 9/2015 Kawano et al.
2015/0260463 A1 9/2015 Laughlin et al.
2015/0263477 A1 9/2015 Onaka
2016/0010907 A1 1/2016 Ali
2016/0114260 A1 4/2016 Frick
2016/0200175 A1 7/2016 Nakajima et al.
2016/0201956 A1 7/2016 Tamura et al.
2016/0216029 A1 7/2016 Ragot
2016/0291137 A1 10/2016 Sakimura et al.
2016/0333747 A1 11/2016 KanFman
2017/0002731 A1 1/2017 Wei

(56) References Cited

U.S. PATENT DOCUMENTS

| | | | | |
|---|---|---|---|---|
| 2017/0081982 | A1* | 3/2017 | Kollmeier | F01K 7/16 |
| 2017/0108263 | A1 | 4/2017 | Cermak et al. | |
| 2017/0167767 | A1 | 6/2017 | Shi et al. | |
| 2017/0205120 | A1 | 7/2017 | Ali et al. | |
| 2017/0219253 | A1* | 8/2017 | Vaisman | F25B 1/10 |
| 2017/0299229 | A1* | 10/2017 | Carter | F25B 6/02 |
| 2018/0023805 | A1* | 1/2018 | Qin | B01D 5/0075 122/32 |
| 2018/0111504 | A1 | 4/2018 | Matsusue et al. | |
| 2018/0180307 | A1 | 6/2018 | Owejan et al. | |
| 2018/0209724 | A1* | 7/2018 | Repasky | F25J 1/0249 |
| 2018/0245740 | A1 | 8/2018 | Kaminsky et al. | |
| 2018/0245835 | A1 | 8/2018 | Kamei et al. | |
| 2018/0328638 | A1 | 11/2018 | Mahmoud et al. | |
| 2019/0111764 | A1 | 4/2019 | Oshitani et al. | |
| 2019/0170425 | A1 | 6/2019 | Takami et al. | |
| 2019/0203988 | A1 | 7/2019 | Kobayashi et al. | |
| 2019/0248450 | A1 | 8/2019 | Lee et al. | |
| 2019/0291020 | A1* | 9/2019 | Qin | F22B 37/486 |
| 2019/0293302 | A1* | 9/2019 | Van | F24F 5/0035 |
| 2019/0393525 | A1* | 12/2019 | Diethelm | H01M 8/04753 |
| 2020/0158386 | A1 | 5/2020 | Wu et al. | |
| 2020/0239109 | A1 | 7/2020 | Lee et al. | |
| 2020/0363101 | A1 | 11/2020 | Jansen | |

OTHER PUBLICATIONS

U.S. Appl. No. 16/448,271, filed Jun. 21, 2019, Vaisman et al.
U.S. Appl. No. 16/448,283, filed Jun. 21, 2019, Vaisman et al.
U.S. Appl. No. 16/448,332, filed Jun. 21, 2019, Vaisman et al.
U.S. Appl. No. 16/448,388, filed Jun. 21, 2019, Vaisman et al.
U.S. Appl. No. 16/666,851, filed Oct. 29, 2019, Davis et al.
U.S. Appl. No. 16/666,859, filed Oct. 29, 2019, Davis et al.
U.S. Appl. No. 16/666,865, filed Oct. 29, 2019, Davis et al.
U.S. Appl. No. 16/666,881, filed Oct. 29, 2019, Davis et al.
U.S. Appl. No. 16/666,899, filed Oct. 29, 2019, Davis et al.
U.S. Appl. No. 16/666,940, filed Oct. 29, 2019, Vaisman et al.
U.S. Appl. No. 16/666,950, filed Oct. 29, 2019, Vaisman et al.
U.S. Appl. No. 16/666,954, filed Oct. 29, 2019, Vaisman et al.
U.S. Appl. No. 16/666,959, filed Oct. 29, 2019, Vaisman et al.
U.S. Appl. No. 16/666,962, filed Oct. 29, 2019, Vaisman et al.
U.S. Appl. No. 16/666,966, filed Oct. 29, 2019, Vaisman et al.
U.S. Appl. No. 16/666,973, filed Oct. 29, 2019, Vaisman et al.
U.S. Appl. No. 16/666,977, filed Oct. 29, 2019, Vaisman et al.
U.S. Appl. No. 16/666,986, filed Oct. 29, 2019, Vaisman et al.
U.S. Appl. No. 16/666,992, filed Oct. 29, 2019, Vaisman et al.
U.S. Appl. No. 16/666,995, filed Oct. 29, 2019, Vaisman et al.
U.S. Appl. No. 16/684,775, filed Nov. 15, 2019, Peters et al.
U.S. Appl. No. 16/807,340, filed Mar. 3, 2020, Vaisman.
U.S. Appl. No. 16/807,353, filed Mar. 3, 2020, Vaisman.
U.S. Appl. No. 16/807,411, filed Mar. 3, 2020, Vaisman.
U.S. Appl. No. 16/807,413, filed Mar. 3, 2020, Vaisman.
U.S. Appl. No. 16/807,582, filed Mar. 3, 2020, Vaisman.
U.S. Appl. No. 16/872,584, filed May 12, 2020, Vaisman et al.
U.S. Appl. No. 16/872,590, filed May 12, 2020, Vaisman et al.
U.S. Appl. No. 16/872,592, filed May 12, 2020, Vaisman et al.
[No Author Listed], "Thermostatic Expansion Valves" Theory of Operation, Application, and Selection, Bulletin 10-9, Sporlan, Mar. 2011, 19 pages.
ammonia21.com [online], "R717 vs r404a do the advantages outweigh the disadvantages," Nov. 30, 2012, retrieved from <http://www.annnnonia21.conn/articles/3717/>, 13 pages.
Elstroem, "Capacitive Sensors Measuring the Vapor Quality, Phase of the refrigerant and Ice thickness for Optimized evaporator performance," Proceedings of the 13th HR Gustav Lorentzen Conference on Natural Refrigerants (GL:2018), Valencia, Spain, Jun. 18-20, 2018, 10 pages.
Elstroem, "New Refrigerant Quality Measurement and Demand Defrost Methods," 2017 IIAR Natural Refrigeration Conference & Heavy Equipment Expo, San Antonio, TX, Technical Paper #1, 38 pages.
en.wikipedia.org [online] "Inert gas—Wikipedia" retrieved on Oct. 1, 2021, retrieved from URL <https://en.wikipedia.org/w/index.php?title=Inert_gas&oldid=1047231716>, 4 pages.
en.wikipedia.org [online] "Pressure regulator—Wikipedia," retrieved on Oct. 7, 2021, retrieved from URL < https://en.wikipedia.org/wiki/Pressure_regulator>, 8 pages.
en.wikipedia.org [online], "lsenthalpic process—Wikipedia, the free encyclopedia," available on or before Mar. 29, 2015, via Internet Archive: Wayback Machine URL <https://web.archive.org/web/20150329105343/https://en.wikipedia.org/wiki/lsenthalpicprocess>, retrieved on Jan. 12, 2021, retrieved from URL <https://en.wikipedia.org/wiki/lsenthalpicprocess>, 2 pages.
en.wikipedia.org [online], "Thermal expansion valve—Wikipedia", Dec. 23, 2020, retrieved on Jan. 8, 2021, retrieved from URL <https://en.wikipedia.org/wiki/Thernnal expansion valve>, 4 pages.
en.wikipedia.org [online], "Thermal expansion valve—Wikipedia," available on or before Feb. 14, 2015, via Internet Archive: Wayback Machine URL <https://web.archive.org/web/20150214054154/https://en.wikipedia.org.wiki/Thermal_expansion_valve>, retrieved on Jan. 12, 2021, URL <https://en.wikipedia.org.wiki/Thermal_expansion_valve>, 3 pages.
engineersedge.com [online], "Throttling Process Thermodynamic," Apr. 16, 2015, via Internet Archive: Wayback Machine URL <https://web.archive.org/web/20150416181050/https://www.engineersedge.conn/thernnodynannics/throttling process.htm>, retrieved on Jan. 12, 2021, retrieved from URL <https://en.wikipedia.org/wiki/lsenthalpicprocess>, 1 pages.
International Search Report and Written Opinion in International Appln. No. PCT/US2020/056787, dated Jan. 27, 2021, 13 pages.
NASA History Office, "Quest for Performance: The Evolution of Modem Aircraft, Part II: The Jet Age, Chapter 10: Technology of the Jet Airplane, Turbojet and Turbofan Systems," NASA Scientific and Technical Information Branch, originally published in 1985, last updated Aug. 6, 2004, 21 pages.
Ohio.edu [online], "20 Engineering Thermodynamics Israel Urieli", Sep. 9, 2009, retrieved from URL< https://www.ohio.edu/mechanical/thermo/Intro/Chapt.1_6/Chapter2a.html>, 1 page.
osha.gov, [online] "Storage and handling of anhydrous ammonia," Part No. 1910, Standard No. 1910.111, GPO Source: e-CFR, 2005, retrieved on Oct. 2, 2021, retrieved from URL <https://www.osha.gov/laws-regs/regulations/standardnumber/1910/1910.111>, 31 pages.
thermal-engineering.org [online] "What is Vapor Quality—Dryness Fraction—Definition," May 22, 2019, retrieved on Oct. 19, 2021, retrieved from URL < https://www.thermal-engineering.org/what-is-vapor-quality-dryness-fraction-definition/>, 6 pages.
Wojtan et al., "Investigation of flow boiling in horizontal tubes: Part I—A new diabatic two-phase flow pattern map. International journal of heat and mass transfer," Jul. 2005, 48(14):2955-69.
Wojtan et al., "Investigation of flow boiling in horizontal tubes: Part II—Development of a new heat transfer model for stratified-wavy, dryout and mist flow regimes," International journal of heat and mass transfer, Jul. 2005, 48(14):2970-85.
forumautomation.com [online], "What is an expansion valve and what are its types," Jun. 14, 2020, retrieved on Jan. 10, 2022, retrieved from URLhttps://forumautomation.com/t/what-is-an-expansion-valve-and-what-are-its-types/8385, 5 pages.
HBDX—Sensor & Regulator, instruction-manual, H B Products (Year: 2022).

* cited by examiner

THERMAL MANAGEMENT SYSTEMS

CLAIM OF PRIORITY

This application is a continuation of U.S. application Ser. No. 16/666,992, filed Oct. 29, 2019, and claims priority under 35 USC § 119(e) to U.S. Provisional Patent Application Ser. No. 62/754,111, filed on Nov. 1, 2018, and entitled "THERMAL MANAGEMENT SYSTEMS," the entire contents of which are hereby incorporated by reference.

BACKGROUND

Refrigeration systems absorb thermal energy from the heat sources operating at temperatures below the temperature of the surrounding environment, and discharge thermal energy into the surrounding environment. Conventional refrigeration systems can include at least a compressor, a heat rejection exchanger (i.e., a condenser), a liquid refrigerant receiver, an expansion device, and a heat absorption exchanger (i.e., an evaporator). Such systems are closed circuit systems and can be used to maintain operating temperature set points for a wide variety of cooled heat sources (loads, processes, equipment, systems) thermally interacting with the evaporator. Closed-circuit refrigeration systems may pump significant amounts of absorbed thermal energy from heat sources into the surrounding environment. Condensers and compressors can be heavy and can consume relatively large amounts of power. In general, the larger the amount of absorbed thermal energy that the system is designed to handle, the heavier the refrigeration system and the larger the amount of power consumed during operation, even when cooling of a heat source occurs over relatively short time periods.

SUMMARY

This disclosure features thermal management systems that include open circuit refrigeration systems (OCRSs) with a pump that recirculates non-evaporated refrigerant and in some embodiments overfeeds the evaporator with liquid refrigerant. This allows for more efficient use of the evaporator's heat transfer surface and can result in a reduction of an evaporator's physical dimensions with respect to a similar evaporator in a OCRS without recirculating non-evaporated refrigerant for a given amount of heat transfer. The OCRS also can improve refrigerant distribution, and reduce an amount of exhausted refrigerant.

Open circuit refrigeration systems generally include a liquid refrigerant receiver, an expansion device, and a heat absorption exchanger (i.e., an evaporator). The receiver stores liquid refrigerant which is used to cool heat loads. Typically, the longer the desired period of operation of an open circuit refrigeration system, the larger the receiver and the charge of refrigerant fluid contained within it. OCRSs will be useful in many circumstances, especially in systems where dimensional and/or weight constraints are such that heavy compressors and condensers typical of closed circuit refrigeration systems are impractical, and/or power constraints make driving the components of closed circuit refrigeration systems infeasible.

According to an aspect, a thermal management system includes an open circuit refrigeration circuit that has a refrigerant fluid flow path, with the refrigerant fluid flow path including a receiver configured to store a refrigerant fluid, the receiver having an outlet, a liquid separator having an inlet, a liquid side outlet, and a vapor side outlet, a pump having an inlet and an outlet, with the inlet of the pump coupled to the liquid side outlet of the liquid separator, a first evaporator configured to extract heat from a first heat load that contacts the first evaporator, the evaporator coupled between the receiver and the inlet of the liquid separator, an second evaporator configured to extract heat from a second heat load that contacts the second evaporator, the second evaporator coupled between the liquid side outlet of the liquid separator and the outlet of the pump, a third evaporator configured to extract heat from a third heat load that contacts the third evaporator, the third evaporator having an inlet that is coupled to the liquid side outlet of the liquid separator, a control device, and an exhaust line coupled to the vapor side outlet of the liquid separator through the control device.

Aspects also include methods and computer program products to control the thermal management system with an open circuit refrigerant system that includes a pump.

One or more of the above aspects may include amongst features described herein one or more of the following features.

The liquid side outlet of the liquid separator is a first liquid side outlet that is coupled to the pump, and the liquid separator has a second liquid side outlet, with the inlet to the third evaporator coupled to the second liquid side outlet of the liquid separator.

The system includes a junction device having a first port coupled to the liquid side outlet of the liquid separator, a second port coupled to the inlet of the pump and a third port coupled to the inlet to the third evaporator.

The system includes a junction device coupled to the receiver, with the first and second evaporators configured to operate at different refrigerant rates, by changing one or both of temperatures and refrigerant recirculation rates.

The configuration of the first and second evaporators reduces vapor quality at the outlet of the second evaporator, which increases circulation rate. The third evaporator is configured to operate with heat loads that cooled by the third evaporator in the superheated phase region, without actively controlling superheat. The exhaust line coupled to the vapor side outlet of the liquid separator is a first exhaust line, the system further including a second exhaust line coupled between an outlet of the third evaporator and an ambient. The exhaust line is further coupled to an outlet of the third evaporator.

The control device is a back pressure regulator. The first and second evaporators operate with a vapor quality less than 1.0. The control device is a first control device, the system further including a second control device coupled between the refrigerant receiver and the inlet to the first evaporator. The first control device is a back pressure regulator having an inlet coupled to the vapor side outlet of the liquid separator and the back pressure regulator having an outlet coupled to the exhaust line and the second control device is an expansion valve that expands the liquid refrigerant into a two phase liquid-vapor refrigerant stream.

The system further includes a junction device having a first port coupled to the liquid side outlet of the liquid separator, a second port coupled to the inlet of the pump and a third port coupled to the inlet to the third evaporator. The system further includes a junction device coupled to the receiver, with the first and second evaporators configured to operate at different refrigerant rates, by changing one or both of temperatures and refrigerant recirculation rates.

The third evaporator is configured to operate with heat loads that cooled by the third evaporator in the superheated phase region, without actively controlling superheat.

The control device is a first control device, the system further including a second control device coupled between the liquid side outlet of the liquid separator and the inlet to the third evaporator.

The system further includes a sensor device configured to provide a signal that is a measure of a thermodynamic property of the refrigerant exiting the third evaporator. The sensor device is disposed in proximity to the outlet of the third receiver. The signal from the sensor device controls the second control device. The system further includes a controller device that receives the signal from the sensor device and is configured to generate a control signal to control the second control device.

The system further includes a third control device coupled to the outlet of the third receiver. The third control device is a back pressure regulator. The third control device is a back pressure regulator that regulates a vapor pressure upstream of the third evaporator, and with the back pressure regulator having an outlet that is coupled to an exhaust line.

The system further includes one or more sensor devices configured to measure one or more thermodynamic properties of the refrigerant, and a controller device that receives the one or more signals from the one or more sensor devices, and with the controller configured to generate one or more control signals to control the control device and the pump.

The system further includes a first expansion device coupled between the receiver and the inlet to the first evaporator, a second expansion device coupled between the liquid side outlet of the liquid separator and the inlet to the third evaporator, a back pressure regulator coupled to the exhaust line, plural sensor devices configured to produce plural signals that are measures of plural thermodynamic properties of the refrigerant, and a controller device that receives the plural signals from the plural sensor devices, with the controller configured to generate one or more control signals to control one or more of the pump, the control device, the first and second expansion valves, and the back pressure regulator.

According to an additional aspect, a thermal management system includes a first receiver having an outlet, the first receiver configured to store a gas, and an open circuit refrigeration circuit that has a refrigerant fluid flow path, with the refrigerant fluid flow path including a second receiver configured to store a refrigerant fluid, the second receiver having an outlet, a liquid separator having an inlet, a liquid side outlet, and a vapor side outlet, a pump having an inlet and an outlet, with the inlet of the pump coupled to the liquid side outlet of the liquid separator, a first evaporator configured to extract heat from a first heat load that contacts the first evaporator, the evaporator coupled between the receiver and the inlet of the liquid separator, an second evaporator configured to extract heat from a second heat load that contacts the second evaporator, the second evaporator coupled between the liquid side outlet of the liquid separator and the outlet of the pump, a third evaporator configured to extract heat from a third heat load that contacts the third evaporator, the third evaporator having an inlet that is coupled to the liquid side outlet of the liquid separator, a control device, and an exhaust line coupled to the vapor side outlet of the liquid separator through the control device.

Aspects also include methods and computer program products to control the thermal management system with an open circuit refrigerant system that includes a pump.

One or more of the above aspects may include amongst features described herein one or more of the following features.

The system further includes a control device having an inlet coupled to the outlet of the first receiver and having an outlet coupled to the inlet of the second receiver that is configured to receive the gas from the first receiver and feed the gas to the inlet of the second receiver.

The system further includes a junction device having a first port coupled to the liquid side outlet of the liquid separator, a second port coupled to the inlet of the pump and a third port coupled to the inlet to the third evaporator.

The system further includes a junction device coupled to the receiver, with the first and second evaporators configured to operate at different refrigerant rates, by changing one or both of temperatures and refrigerant recirculation rates.

The third evaporator is configured to operate with heat loads that cooled by the third evaporator in the superheated phase region, without actively controlling superheat. The control device is a first control device, the system further including a second device coupled between the liquid side outlet of the liquid separator and the inlet to the third evaporator, and a sensor device configured to provide a signal that is a measure of a thermodynamic property of the refrigerant exiting the third evaporator, and a controller device that receives the signal from the sensor device and is configured to generate a control signal to control the second control device.

The system further includes a back pressure regulator coupled to the outlet of the third receiver that regulates a vapor pressure upstream of the third evaporator, and with the back pressure regulator having an outlet that is coupled to an exhaust line.

The first and second evaporators operate with a vapor quality less than 1.0, with the system further including a junction device coupled to the receiver, with the first and second evaporators configured to operate at different refrigerant rates, by changing one or both of temperatures and refrigerant recirculation rates, with the third evaporator configured to operate with heat loads that cooled by the third evaporator in the superheated phase region, without actively controlling superheat.

The system further includes one or more sensor devices configured to measure one or more thermodynamic properties of the refrigerant, and a controller device that receives the one or more signals from the one or more sensor devices, and with the controller configured to generate one or more control signals to control the control device and the pump.

The system further includes a first expansion device coupled between the receiver and the inlet to the first evaporator, a second expansion device coupled between the liquid side outlet of the liquid separator and the inlet to the third evaporator, a back pressure regulator coupled to the exhaust line, plural sensor devices configured to produce plural signals that are measures of plural thermodynamic properties of the refrigerant, and a controller device that receives the plural signals from the plural sensor devices, with the controller configured to generate one or more control signals to control one or more of the pump, the control device, the first and second expansion valves, and the back pressure regulator.

One or more of the above aspects may include one or more of the following advantages.

The open circuit refrigeration system described herein includes a pump and a liquid separator. The open circuit refrigeration system with pump (OCRSP) includes two downstream circuits from the liquid separator. One downstream circuit carries a liquid from the liquid separator and includes the pump. The other downstream circuit carries vapor from the liquid separator and includes an exhaust line.

The OCRSP system has a first control device configured to control temperature of the heat load and a second control device configured to control the refrigerant flow rate flowing out of the refrigerant receiver.

The open circuit refrigeration systems disclosed herein uses a mixture of two different phases (e.g., liquid and vapor) of a refrigerant fluid to extract heat energy from a heat load. In particular, for high heat flux loads that are to be maintained within a relatively narrow range of temperatures, heat energy absorbed from the high heat flux load can be used to drive a liquid-to-vapor phase transition in the refrigerant fluid, which transition occurs at a constant temperature. As a result, the temperature of the high heat flux load can be stabilized to within a relatively narrow range of temperatures. Such temperature stabilization can be particularly important for heat-sensitive high flux loads such as electronic components and devices that can be easily damaged via excess heating. Refrigerant fluid emerging from the evaporator can be used for cooling of secondary heat loads that permit less stringent temperature regulation than those electronic components that require regulation within a narrow temperature range.

Exhaust refrigerant can be used in the systems disclosed herein in various ways. It can be discharged into ambient environment if there is no prohibitive regulation. Alternatively, depending upon the nature of the refrigerant fluid, exhaust vapor can be incinerated in a combustion unit and used to perform mechanical work. As another example, the vapor can be scrubbed or otherwise chemically treated.

The open circuit refrigeration systems disclosed herein may have other advantages.

By placing the first and second evaporators at both the outlet and the second inlet of the junction device, it is possible to run the first and second evaporators with changing refrigerant rates through the junction device to change at different temperatures or change recirculating rates. By using the first and second evaporators, the configuration reduces vapor quality at the outlet of the evaporator and thus increases circulation rate, as the pump would be 'pumping' less vapor and more liquid.

In addition, some heat loads that may be cooled by an evaporator in the superheated phase region, at the same time do not need to actively control superheat. The third evaporator in some embodiments can be operated in two-phase region or in superheated region without active superheat control.

In other embodiments, the third evaporator, together with the sensor device and the expansion device coupled to the third evaporator provide superheat control for the third evaporator. The sensor disposed approximate to the outlet of the evaporator provides a measurement of superheat, and indirectly, vapor quality that can be used by an controller or can be used directly to control the expansion device to adjust the expansion device based on the measured superheat relative to a superheat set point value. By doing so, the controller indirectly adjusts the vapor quality of the refrigerant fluid emerging from the third evaporator. Thus, the first and second evaporators operate in two phase (liquid/gas) and the third evaporator operates in superheated region with controlled superheat.

With some aspects, the open circuit refrigeration systems includes a gas receiver. Gas transported to the refrigerant receiver supplies a gas pressure that compresses liquid refrigerant in the refrigerant receiver, maintaining liquid refrigerant in a subcooled state (e.g., as a liquid existing at a temperature below its normal boiling point temperature) even at high ambient and liquid refrigerant temperatures. Transporting gas can occur through a pressure regulator, with the pressure regulator functioning to control pressure in the refrigerant receiver and the refrigerant fluid pressure upstream from the evaporator, that may obviate the need for other control valves between the evaporator and the refrigerant receiver. Pressure regulator can be controlled to start opening to allow gas from the gas receiver to flow into the refrigerant receiver to achieve a desired cooling capacity for one or more thermal loads according to changes in ambient temperatures and/or refrigerant volume in the refrigerant receiver.

Other advantages include the absence of compressors and condensers, which absence can result in a significant reduction in the overall size, mass, and power consumption of such systems, relative to conventional closed-circuit systems, particularly when the open circuit refrigeration systems are sized for operation over relatively short time periods.

The benefit of maintaining the refrigerant fluid within a two-phase (liquid and vapor) region of the refrigerant fluid's phase diagram, is that the heat extracted from high heat flux loads can be used to drive a constant-temperature liquid to vapor phase transition of the refrigerant fluid, allowing the refrigerant fluid to absorb heat from a high heat flux load without undergoing a significant temperature change. Consequently, the temperature of a high heat flux load can be stabilized within a range of temperatures that is relatively small, even though the amount of heat generated by the load and absorbed by the refrigerant fluid is relatively large.

The pump can directly pump a secondary refrigerant fluid flow, e.g., principally liquid refrigerant from the liquid separator provided from the liquid refrigerant exiting the evaporator back to evaporator, and thus in effect increases the amount of refrigerant in the receiver in comparison to approaches in which the liquid from the liquid/vapor phase of refrigerant exits the evaporator is released.

Embodiments of the systems can also include any of the other features disclosed herein, including any combinations of individual features discussed in connection with different embodiments, except where expressly stated otherwise.

Other features and advantages will be apparent from the description, drawings, and claims.

DETAILED DESCRIPTION

I. General Introduction

Cooling of high heat flux loads that are also highly temperature sensitive can present a number of challenges. On the one hand, such loads generate significant quantities of heat that is extracted during cooling. In conventional closed-cycle refrigeration systems, cooling high heat flux loads typically involves circulating refrigerant fluid at a relatively high mass flow rate. However, closed-cycle system components that are used for refrigerant fluid circulation—including compressors and condensers—are typically heavy and consume significant power. As a result, many closed-cycle systems are not well suited for deployment in mobile platforms—such as on small vehicles—where size and weight constraints may make the use of large compressors and condensers impractical.

On the other hand, temperature sensitive loads such as electronic components and devices may require temperature regulation within a relatively narrow range of operating temperatures. Maintaining the temperature of such a load to within a small tolerance of a temperature "set point," i.e., a desired temperature value, can be challenging when a single-phase refrigerant fluid is used for heat extraction, since the refrigerant fluid itself will increase in temperature as heat is absorbed from the load.

Directed energy systems that are mounted to mobile vehicles such as trucks may present many of the foregoing operating challenges, as such systems may include high heat flux, temperature sensitive components that require precise cooling during operation in a relatively short time. The thermal management systems disclosed herein, while generally applicable to the cooling of a wide variety of thermal loads, are particularly well suited for operation with such directed energy systems.

In particular, the thermal management systems and methods disclosed herein include a number of features that reduce both overall size and weight relative to conventional refrigeration systems, and still extract excess heat energy from both high heat flux, highly temperature sensitive components and relatively temperature insensitive components, to accurately match temperature set points for the components. At the same time the disclosed thermal management systems require minimal power compared to conventional closed-cycle refrigeration systems to sustain their operation. Whereas certain conventional refrigeration systems used closed-circuit refrigerant flow paths, the systems and methods disclosed herein use open-cycle refrigerant flow paths. Depending upon the nature of the refrigerant fluid, exhaust refrigerant fluid may be incinerated as fuel, chemically treated, and/or simply discharged at the end of the flow path.

II. Thermal Management Systems with Open Circuit Refrigeration Systems

Figure 1:
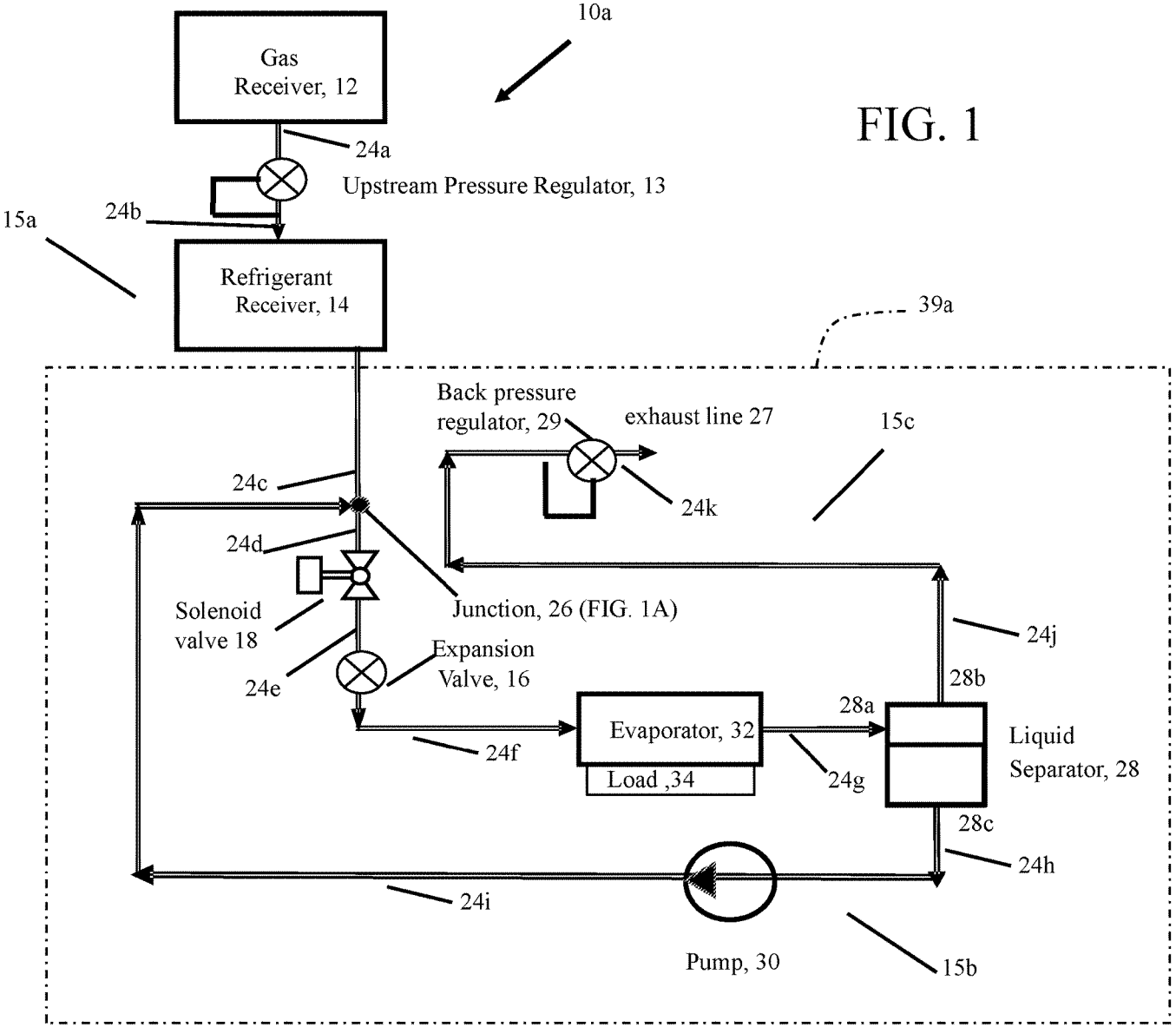
FIG. 1 is a schematic diagram of an example of a thermal management system that includes an open circuit refrigeration system with a pump (OCRSP), with the pump indirectly supplying liquid to the evaporator.

Referring now to FIG. 1, a thermal management system 10 includes an open circuit refrigeration system with pump (OCRSP) system 10*a* and a load 34.

In FIG. 1, embodiment 10*a* of the OCRSP is one of several open circuit refrigeration system with pump 10*a*-10*g* system configurations that will be discussed herein. Also discussed below will be OCRSP 11*a*-11*g* open circuit refrigeration systems with pump system configurations that include one receiver, but which otherwise parallel OCRSP configurations 10*a*-10*g*.

OCRSP 10*a* includes a first receiver 12 that is configured to store a gas that is fed to a first control device 13. The first control device regulates gas pressure from the first receiver 12 and being upstream from a second receiver 14 feeds gas to the second receiver 14. The second receiver 14 is configured to store liquid refrigerant, i.e., subcooled liquid refrigerant. The second receiver 14 is configured to receive the gas from the first receiver 12 and stores the gas above the subcooled liquid refrigerant, ideally such that there is no or nominal mixing of the gas with the subcooled refrigerant. The gas pressure supplied by the gas receiver 12 compresses the liquid refrigerant in the receiver 14 and maintains the liquid refrigerant in a sub-cooled state even at high ambient and liquid refrigerant temperatures.

OCRSP 10*a* also includes an optional first control device, e.g., a solenoid control valve 18, and an optional second control device, e.g., an expansion valve 16. OCRSP 10*a* includes a junction device 26 that has first and second ports configured as inlets, and a third port configured as an outlet. A first one of the inlets of the junction device 26 is coupled to an outlet of the receiver 14 and the second one of the inlets of the junction device 26 is coupled to a pump 30. An inlet of the optional solenoid control valve 18 (if used) is coupled to the outlet of the junction 26. Otherwise the outlet of the junction device 26 is coupled to feeds an input of the second control device, e.g., the expansion valve 16 (if used) or if nether solenoid control valve 18 nor the expansion valve 16 is used the outlet of the junction device 26 is coupled to an evaporator 32.

Figure 1B:
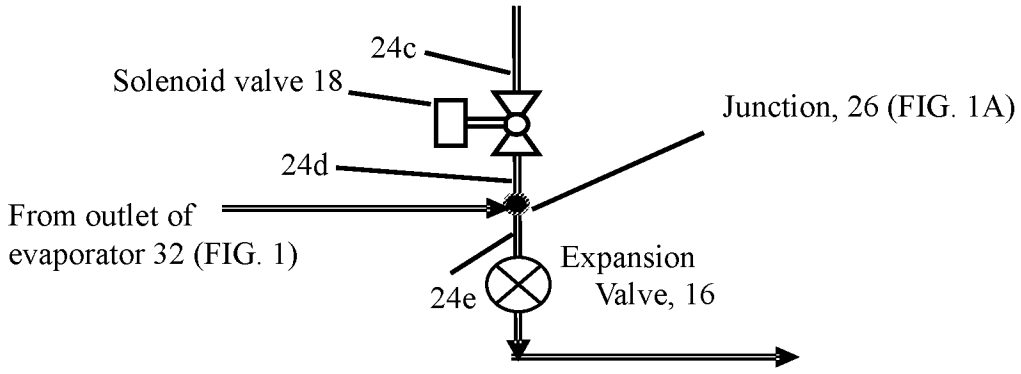
FIGS. 1B and 1C are schematic views of alternative locations for a junction device that is used in the embodiments of the open circuit refrigeration with a pump (OCRSP).
Figure 1A:
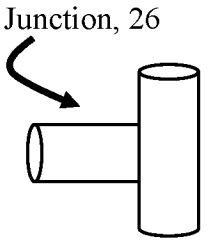
FIG. 1A is a diagrammatical view of a junction device.

FIG. 1A shows a diagrammatical view of the junction device 26 having at least three ports any of which could be inlets or outlets. Generally, in the configurations below two of the ports would be inlets and one would be an outlet and refrigerant flows from the two ports acting as inlets would be combined and exit the outlet.

FIG. 1B shows an alternative location for the junction device 26 having one of the inlets and the outlet interposed between solenoid valve 18 and expansion valve 16 having its other inlet coupled to the outlet of the evaporator 32.

Figure 1C:
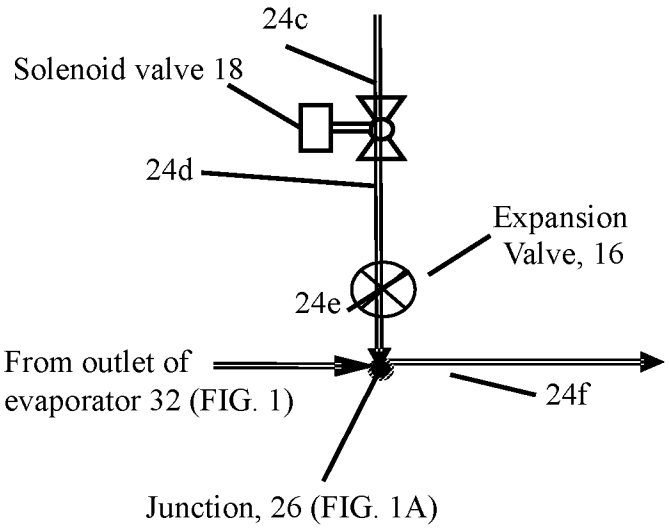

FIG. 1C shows another alternative location for the junction device 26 having one of the inlets and the outlet interposed between the outlet of the expansion valve 16 and the evaporator 32 (FIG. 2) or liquid separator 28 (FIG. 3) and having its other inlet coupled to the outlet of the evaporator 32.

Any of the configurations that will be discussed below in FIGS. 2 to 8, 12A, 12B, 13 and 14 can have the junction device 26 placed in the various locations as shown in FIG. 1 or FIG. 1B or 1C. If both of the optional solenoid control valve 18 and optional expansion valve 16 are not included, then all of the locations for the junction device 26 are in essence the same, provided that there are no other intervening functional devices between the outlet of the receiver 14 and the inlet (that is in the refrigerant flow path 15*a*) of the junction device 26.

Returning to FIG. 1, the OCRSP 10*a* also includes an evaporator 32 that has an inlet coupled to an outlet of the expansion valve 16. The evaporator 32 also has an outlet coupled to an inlet 28*a* of a liquid separator 28. The liquid separator 28 in addition to the inlet 28*a*, has a first outlet (vapor side outlet) 28*b* and a second outlet 28*c* (liquid side outlet). The first outlet 28*b* of the liquid separator 28 is coupled to an inlet (not referenced) of third control device, such as a back pressure regulator 29 that controls a vapor pressure in the evaporator 32. The back pressure regulator 29 has an outlet (not referenced) that feeds an exhaust line 27. The second outlet of the liquid separator 28 is coupled to an inlet of a pump 30. An output of the pump 30 is coupled to the second input of the junction device 26. In the liquid separator 28 only or substantially only liquid exits the liquid separator at outlet 28*c* (liquid side outlet) and only or substantially only vapor exits the separator 28 at outlet 28*b* the (vapor side outlet).

The evaporator 32 is configured to be coupled to a thermal load 34. The thermal management system 10 includes the thermal load 34 that is coupled to OCRSP 10*a* in thermal communication with the evaporator 32. The evaporator 32 is configured to extract heat from the thermal load 34 that is in contact with the evaporator 32. Conduits 24*a*-24*k* couple the various aforementioned items, as shown. In addition, a portion 39*a* of the OCRSP 10*a* is demarked by a phantom box, which will be used in the discussion of FIG. 8A.

The OCRSP 10*a* can be viewed as including three circuits. A first circuit 15*a* being the refrigerant flow path 15*a* that includes the receivers 12 and 14, and two downstream circuits 15*b* and 15*c* that are downstream from the liquid separator 28. Downstream circuit 15*b* carries liquid from the liquid separator 28 via the pump 30, which liquid is pumped back into the evaporator 32 indirectly via the junction device 26 and the downstream circuit 15*c* that includes the back pressure regulator 29, which exhausts vapor via the exhaust line 27.

Receivers 12, 14 are typically implemented as insulated vessels that store gas and refrigerant fluid, respectively, at relatively high pressures.

In FIG. 1, the control device 13 is configurable to control a flow of the gas from the first receiver 12 to the second receiver 14 to regulate pressure in the second receiver 14 and control refrigerant flow from the second receiver 14. The control device can be a pressure regulator that regulates a pressure at an outlet of the pressure regulator 13. Pressure regulator 13 generally functions to control the gas pressure from gas receiver 12 that is upstream of the refrigerant receiver 14. Transporting a gas from the gas receiver 12 into the refrigerant receiver 14 through pressure regulator 13, either prior to or during transporting of the refrigerant fluid from the refrigerant receiver 14, functions to control the pressure in the refrigerant receiver 14 and the refrigerant fluid pressure upstream from the evaporator 32, especially when the optional valves 16 and 18 are not used. Pressure regulator 13 would be used at the outlet of the first receiver 12 to regulate the pressure in the second receiver 14. For example, the pressure regulator 13 could start in a closed position, and as refrigerant pressure in the second receiver 14 drops the pressure regulator 13 can be controlled to start opening to allow gas from the first receiver 12 to flow into the second receiver 14 to substantially maintain a desired pressure in the second receiver 14 and thus provide a certain sub-cooling of the refrigerant in the receiver 12, and a certain refrigerant mass flow rate through the expansion device 16, and evaporator 32, and, as a result, a desired cooling capacity for one or more thermal loads 34.

In general, pressure regulator 13 can be implemented using a variety of different mechanical and electronic devices. Typically, for example, pressure regulator 13 can be implemented as a flow regulation device that will match an output pressure to a desired output pressure setting value. In general, a wide range of different mechanical and electrical/electronic devices can be used as pressure regulator 13. Typically, a mechanical pressure regulator includes a restricting element, a loading element, and a measuring element. The restricting element is a valve that can provide a variable restriction to the flow. The loading element, e.g., a weight, a spring, a piston actuator, etc., applies a needed force to the restricting element. The measuring element functions to determine when the inlet flow is equal to the outlet flow.

In other embodiments, receiver 12 and the control device 13 are not used, see FIG. 8. When the receiver 12 is not used to maintain pressure in the second receiver 14, refrigerant flow is controlled either solely by the expansion device 16, and the back pressure regulator 29, and the control strategies of those controls depends on requirements of the application, e.g., ranges of mass flow rates, cooling requirements, receiver capacity, ambient temperatures, thermal load, etc.

Examples of suitable commercially available downstream pressure regulators that can function as control device 13 include, but are not limited to, regulators available from Emerson Electric (https://www.emerson.com/documents/automation/regulators-mini-catalog-en-125484.pdf).

For the expansion valve 16, a fixed orifice device can be used. Alternatively, the expansion valve 16 can be an electrically controlled expansion valve. Typical electrical expansion valves include an orifice, a moving seat, a motor or actuator that changes the position of the seat with respect to the orifice, a controller (see FIG. 13), and sensors. The sensors may monitor, vapor quality at the evaporator exit, pressure in the refrigerant receiver if the gas receiver is not employed, pressure differential across the expansion valve 16, pressure drop across the evaporator, liquid level in the liquid separator, power input into the electrically actuated heat loads, or a combination of the above.

Examples of suitable commercially available expansion valves that can function as device 16 include, but are not limited to, thermostatic expansion valves available from the Sporlan Division of Parker Hannifin Corporation (Washington, Mo.) and from Danfoss (Syddanmark, Denmark).

In general, the control device 18 can be implemented as a solenoid control valve 18, preferably normally closed, operating as an on/off device. A solenoid valve includes a solenoid that uses an electric current to generate a magnetic field to control a mechanism to regulates an opening in a valve to control fluid flow. The control device 18 is configurable to stop the refrigerant flow such as an on/off valve.

The back pressure regulator 29 at the vapor side outlet 28*b* of the liquid separator 28 generally functions to control the vapor pressure upstream of the back pressure regulator 29. In OCRSP 10*a*, the back pressure regulator 29 is a control device that controls the vapor pressure from the liquid separator 28 and indirectly controls evaporating pressure/temperature. In general, control device 29 can be implemented using a variety of different mechanical and electronic devices. Typically, for example, control device 29 can be implemented as a flow regulation device. The back pressure regulator 29 regulates fluid pressure upstream from the regulator, i.e., regulates the pressure at the inlet to the regulator 29 according to a set pressure point value.

Various types of pumps can be used for pump 30. Exemplary pump types include gear, centrifugal, rotary vane, etc. When choosing a pump, the pump should be capable to withstand the expected fluid flows, including criteria such as temperature ranges for the fluids, and materials of the pump should be compatible with the properties of the fluid. A subcooled refrigerant can be provided at the pump 30 outlet to avoid cavitation. To do that a certain liquid level in the liquid separator 28 may provide hydrostatic pressure corresponding to that sub-cooling.

Evaporator 32 can be implemented in a variety of ways. In general, evaporator 32 functions as a heat exchanger, providing thermal contact between the refrigerant fluid and heat load 34 that is coupled to the OCRSP 10*a*. Typically, evaporator 32 includes one or more flow channels extending internally between an inlet and an outlet of the evaporator, allowing refrigerant fluid to flow through the evaporator and absorb heat from heat load 34. A variety of different evaporators can be used in OCRSP 10*a*. In general, any cold plate may function as the evaporator of the open circuit refrigeration systems disclosed herein. Evaporator 32 can accommodate any number and type of refrigerant fluid channels (including mini/micro-channel tubes), blocks of printed circuit heat exchanging structures, or more generally, any heat exchanging structures that are used to transport single-phase or two-phase fluids. The evaporator 32 and/or components thereof, such as fluid transport channels, can be attached to the heat load mechanically, or can be welded, brazed, or bonded to the heat load in any manner.

In some embodiments, evaporator 32 (or certain components thereof) can be fabricated as part of heat load 34 or otherwise integrated into the heat load 34.

The evaporator 32 can be implemented as plurality of evaporators connected in parallel and/or in series. The evaporator 32 can be coupled into a basic OCRSP in a variety of ways to provide different embodiments of the OCRSP, with OCRSP 10*a* being a first example.

In FIG. 1, the evaporator 32 is coupled to the inlet of the liquid separator 28 and to an outlet of the expansion device 16. The liquid refrigerant from the refrigerant receiver 14 mixes with an amount of pumped refrigerant from the pump 30, and expands at a constant enthalpy in the expansion device 16. The expansion device 16 turns the liquid into a two-phase mixture. The two-phase mixture stream enters the evaporator 32. The evaporator absorbs the heat load and liquid/vapor from the evaporator enters the liquid separator 28. The liquid stream exiting the liquid separator 28 is pumped by the pump 30 back into the expansion device 16 via the junction device 26. In this configuration, the pump 30 indirectly pumps a secondary refrigerant fluid flow, e.g., a recirculation liquid refrigerant flow from the evaporator 32, via the liquid separator 28, back via the expansion device 16 into the evaporator 32.

If the junction 26 is upstream of the valve 18, in some cases the pump 30 may return a portion of the liquid refrigerant from the liquid separator 28 effectively back to the receiver 14 (via the junction device 26) so long as the remaining liquid column in the liquid separator remains sufficiently high to permits substantially cavitation free operation of the pump 30. The evaporator 32 may be configured to maintain exit vapor quality below the so called "critical vapor quality" defined as "1." Vapor quality is the ratio of mass of vapor to mass of liquid+vapor and in the systems herein is generally kept in a range of approximately 0.5 to almost 1.0; more specifically 0.6 to 0.95; more specifically 0.75 to 0.9 more specifically 0.8 to 0.9 or more specifically about 0.8 to 0.85. "Vapor quality" is thus defined as mass of vapor/total mass (vapor+liquid). In this sense, vapor quality cannot exceed "1" or be equal to a value less than "0."

In practice vapor quality may be expressed as "equilibrium thermodynamic quality" that is calculated as follows:

$$X=(h-h')/(h''-h'),$$

where h—is specific enthalpy, specific entropy or specific volume, '—means saturated liquid and "—means saturated vapor. In this case X can be mathematically below 0 or above 1, unless the calculation process is forced to operate differently. Either approach for calculating vapor quality is acceptable.

Referring back to FIG. 1, the OCRSP 10*a* operates as follows. Gas from the gas receiver 12 is directed into the refrigerant receiver 14. The gas is used to maintain an established pressure in the receiver 14. The liquid refrigerant from the receiver 14 mixes with the refrigerant from the pump 30. The mixed refrigerant is fed to the inlet of the expansion valve 16 and expands at a constant enthalpy in the expansion valve 30 and turns into a two-phase (gas/liquid) mixture. The two-phase mixture or stream from the expansion valve enters the evaporator 32. The evaporator 32 provides cooling duty and discharges the refrigerant in a two-phase state at a vapor quality close to 1.0 by configuring the evaporator 32 to provide a fraction of vapor to liquid, e.g., at 1 or below but almost equal to 1. (Suitable vapor qualities will range from 0.6 to 0.99; 0.7 to 0.9 and 0.8-0.9. Other values are possible. The stream from the evaporator 32 is fed into the inlet of the liquid separator 28. The junction device 26 receives the refrigerant flow exiting the pump 30 and combines it with the primary flow from the second receiver 14.

Any vapor that may be included in the refrigerant stream will be discharged at the vapor phase outlet of the liquid separator 28. Refrigerant vapor exits from the vapor side outlet 28*b* of the liquid separator 28 and is exhausted by the exhaust line 27. The back pressure regulator 29, regulates the pressure upstream of the regulator 29 so as to maintain upstream refrigerant fluid pressure in OCRSP 10*a*.

As mentioned above, the OCRSP 10*a* of FIG. 1 is one of several alternative system architectures that have a liquid separator 28 and pump 30 as part of the OCRSP cooling system.

Figure 2:
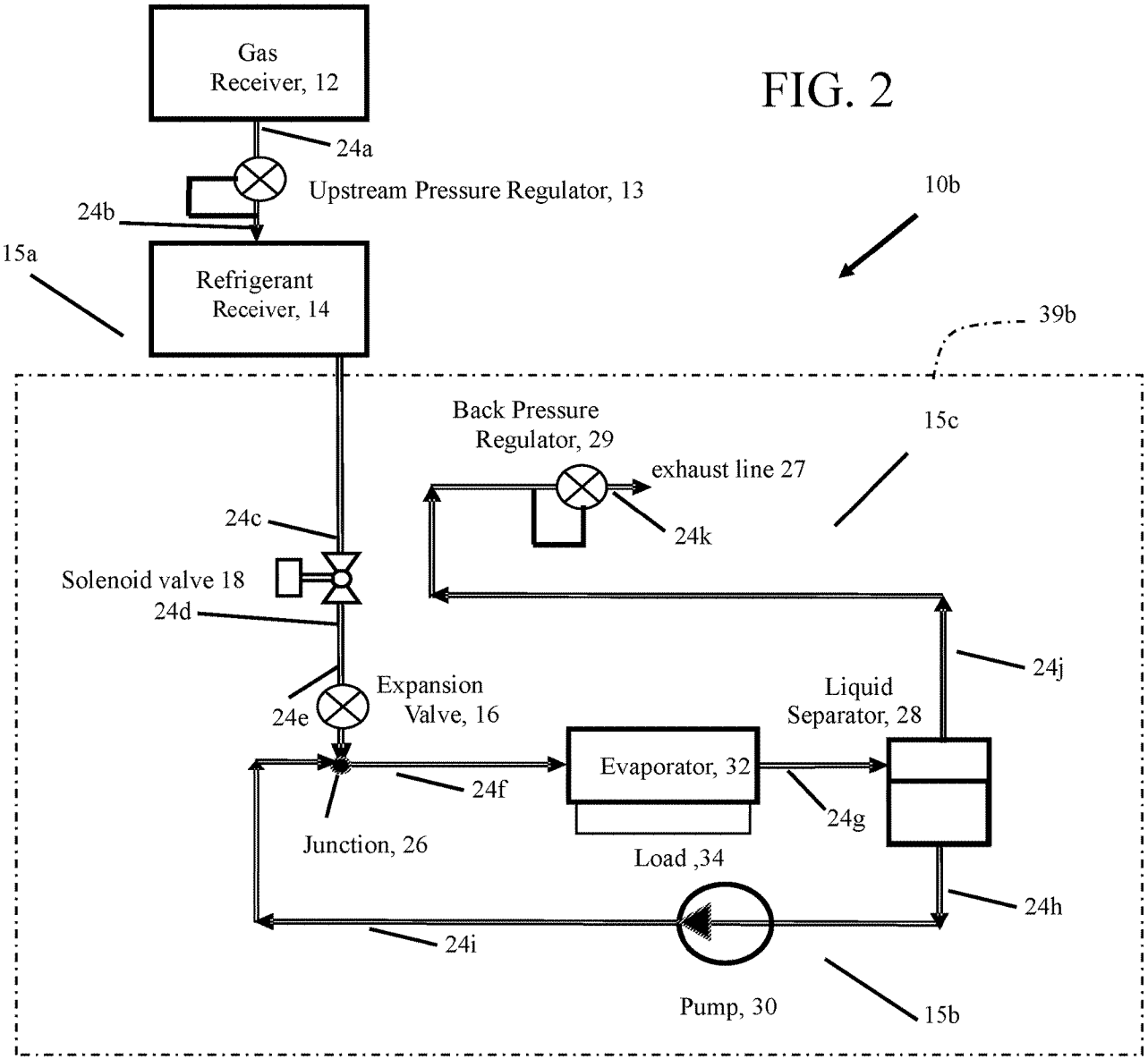
FIG. 2 is a schematic diagram of an alternative example of the OCRSP with the pump directly supplying liquid to the evaporator.

Referring now to FIG. 2, the system 10 includes an alternative open circuit refrigeration system with pump (OCRSP) 10*b*. OCRSP 10*b* includes the first receiver 12, the pressure regulator 13 and the second receiver 14 as discussed for FIG. 1. OCRSP 10*b* also includes solenoid control valve 18, expansion valve, 16, evaporator 32, liquid separator 28, pump 30 and back pressure regulator 29, coupled to the exhaust line 27, as discussed above. OCRSP 10*b* also includes the junction device 26. The junction device 26 has one port as an inlet coupled to the outlet of the pump 30, and a second port as an outlet coupled to the inlet to the evaporator, but in OCRSP 10*b* the junction device 26 has a third port as a second inlet coupled to the output of the expansion valve 16. Conduits 24*a*-24*m* couple the various aforementioned items as shown. In addition, a portion 39*b* of the OCRSP 10*b* is demarked by a phantom box, which will be used in the discussion of FIG. 8B.

In OCRSP 10*b*, the pumped liquid from the pump 30 is fed directly into the inlet to the evaporator 32 along with the primary refrigerant flow from the expansion valve 16. These liquid refrigerant steams from the refrigerant receiver and the pump are mixed downstream from the expansion valve 16. The thermal load 34 is coupled to the evaporator 32. The evaporator 32 is configured to extract heat from the load 34 that is in contact with the evaporator 32 and to control the vapor quality at the outlet of the evaporator. The OCRSP 10*b* can also be viewed as including three circuits. The first circuit 15*a* being the refrigerant flow path and the two circuits 15*b* and 15*c* as in FIG. 1.

The OCRSP 10*b* operates as follows. Gas from the gas receiver 12 is directed into the refrigerant receiver 14. The gas is used to maintain an established pressure in the receiver 14, as discussed above. The liquid refrigerant from the receiver 14 is fed to the expansion valve and expands at a constant enthalpy in the expansion valve turning into a two-phase (gas/liquid) mixture. This two-phase liquid/vapor refrigerant stream and the pumped liquid refrigerant stream from the pump 30 enter the evaporator 32 that provides cooling duty and discharges the refrigerant in a two-phase state at a relatively high exit vapor quality (fraction of vapor to liquid, as discussed above). The discharged refrigerant is fed to the inlet of the liquid separator 28, where the liquid separator 28 separates the discharge refrigerant with only or substantially only liquid exiting the liquid separator at outlet 28*c* (liquid side outlet) and only or substantially only vapor exiting the separator 28 at outlet 28*b* the (vapor side outlet). The liquid stream exiting at outlet 28*c* enters and is pumped by the pump 30 into the second inlet of the junction.

OCRSP 10*b* provides an operational advantage over the embodiment of OCRSP 10*a* (FIG. 1) since the pump 30 can operate across a reduced pressure differential (pressure difference between inlet and outlet of the pump 30). In the context of open circuit refrigeration systems, the use of the pump 30 allows for some recirculation of liquid refrigerant from the liquid separator 28 to enable operation at reduced vapor quality at the evaporator 32 outlet, that also avoids discharging remaining liquid out of the system at less than the separation efficiency of the liquid separator 28 allows. That is, by allowing for some recirculation of liquid phase refrigerant, but without the need for a compressor and condenser, as in a closed cycle refrigeration system, this recirculation reduces the required amount of refrigerant needed for a given amount of cooling over a given period of operation.

The configuration above reduces the vapor quality at the evaporator 32 inlet and thus may improve refrigerant distribution (of the two phase mixture) in the evaporator 32.

During start-up both OCRSP 10*a* and OCRSP 10*b* (FIGS. 1, 2) need to charge the evaporator 32 with liquid refrigerant. However, in both OCRSP 10*a* and OCRSP 10*b*, by placing the evaporator 32 between the outlet of the expansion device and the inlet of the liquid separator, these configurations avoid the necessity of having liquid refrigerant first pass through the liquid separator 29 during the initial charging of the evaporator 32 with the liquid refrigerant, in contrast with the OCRSP 10*a* (FIG. 1). At the same time, liquid refrigerant that is trapped in the liquid separator 28 may be wasted after the OCRSP 10*b* shuts down.

Figure 3:
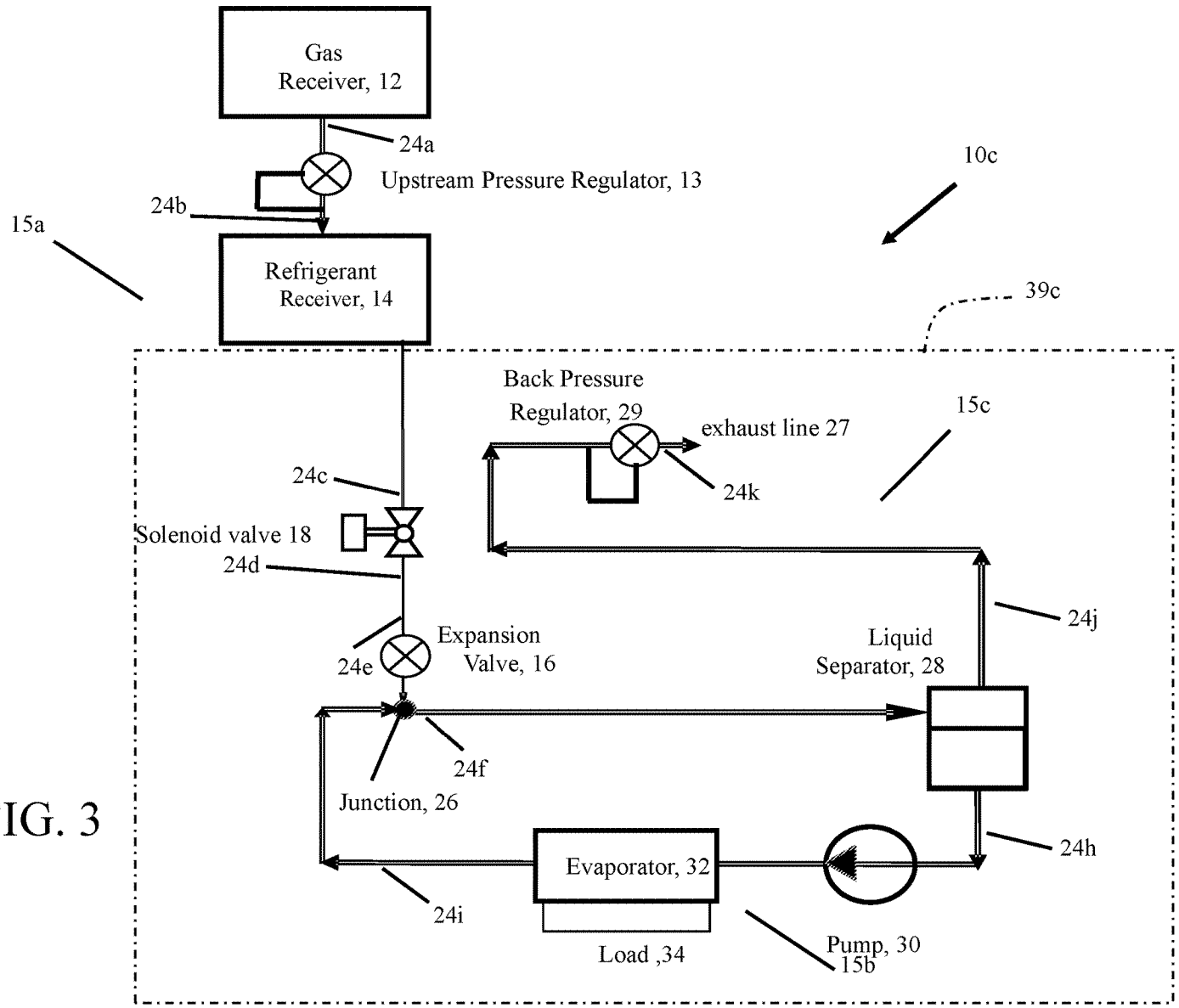
FIG. 3 is a schematic diagram of an alternative example of the OCRSP.

Referring now to FIG. 3, the system 10 includes another alternative open circuit refrigeration system with pump (OCRSP) 10*c*. OCRSP 10*c* includes the first receiver 12, the pressure regulator 13 and the second receiver 14 as discussed for FIG. 1. OCRSP 10*c* also includes solenoid control valve 18, expansion valve, 16, liquid separator 28, pump 30 and back pressure regulator 29, coupled to the exhaust line 27, as discussed above.

OCRSP 10*c* also includes the junction device 26 and evaporator 32. The junction device 26 has one port as an inlet coupled to the outlet of the expansion valve 16, a second port as an outlet coupled to the inlet of the liquid separator 28 and has a third port as a second inlet coupled to the evaporator 32. OCRSP 10*c* has the inlet to the evaporator 32 coupled to the output of the pump 30 and has the outlet coupled to the second inlet of the junction device 26. A thermal load 34 is coupled to the evaporator 32. The evaporator 32 is configured to extract heat from the load 34 that is in contact with the evaporator 32. Conduits 24*a*-24*m* couple the various aforementioned items as shown. In addition, a portion 39*c* of the OCRSP 10*c* is demarked by a phantom box, which will be used in the discussion of FIG. 8C.

Vapor quality downstream from the expansion valve 16 is higher than the vapor quality downstream from the pump 30. An operating advantage of the OCRSP 10*d* is that by placing the evaporator 32 downstream from the pump 30 better refrigerant distribution is provided with this component configuration since liquid refrigerant enters the evaporator 32 rather than a liquid/vapor stream.

The OCRSP 10*d* can also be viewed as including three circuits. The first circuit 15*a* being the refrigerant flow path and the other two being the circuits 15*b* and 15*c*, as in FIG. 1.

Evaporators of the first two configurations (FIGS. 1 and 2) operate below a vapor quality of 1. These architectures are not very sensitive to the pumping flow capacity and do not need a precise flow control, i.e., a constant speed pump configured to meet highest load requirements can be employed.

The evaporator 32 of the configuration in FIG. 3 may allow a superheat. The configuration of FIG. 3 may be sensitive to the pumping flow capacity. If the evaporator of FIG. 3 is configured to strictly maintain vapor quality at the evaporator exit, vapor quality control may be provided by a variable speed pump (not shown) and a controller (FIG. 15) acting on a value of vapor quality that is sensed downstream from the evaporator 32. If the evaporator 32 of FIG. 3, is configured to operate in the range extended into the superheated region and the pump 30, the superheat control may be provided by a variable speed pump and a controller acting on pressure and temperatures sensed downstream from the evaporator.

Figure 4:
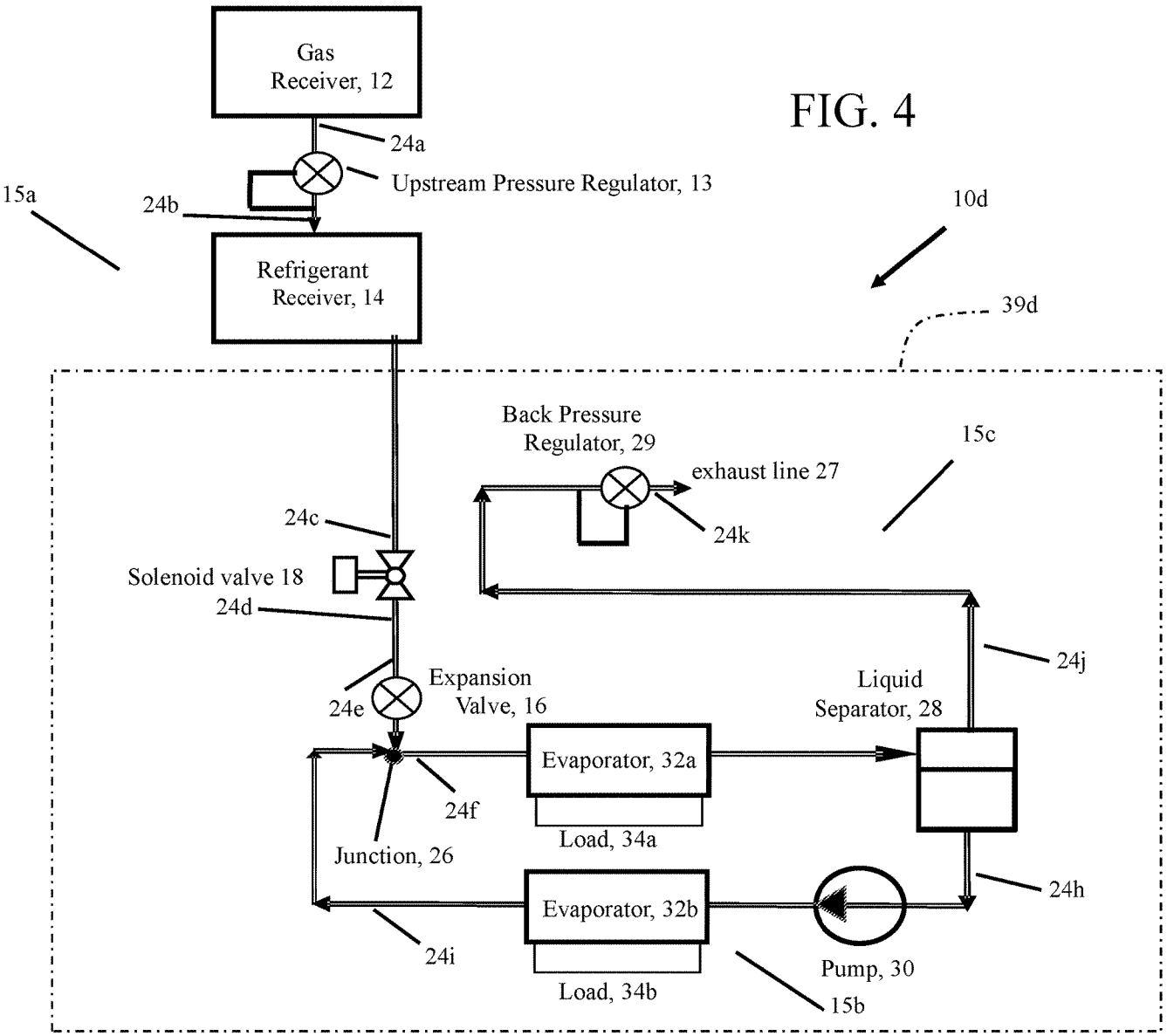
FIG. 4 is a schematic diagram of another alternative example of a thermal management system that includes OCRSP with two evaporators.

Referring now to FIG. 4, the system 10 can include another alternative open circuit refrigeration system with pump (OCRSP) 10*d*. OCRSP 10*d* includes the first receiver 12, the pressure regulator 13, and the second receiver 14, expansion valve 16, and solenoid control valve 18, pump 30, liquid separator 28, and back pressure regulator 29, coupled to the exhaust line 27, as discussed above.

OCRSP 10*d* also includes the junction device 26, a first evaporator 32*a* and a second evaporator 32*b*. The junction device 26 has a first port as an inlet coupled to the outlet of the expansion valve 16. The junction device 26 has a second port as an outlet coupled to an inlet of the first evaporator 32*a*, with the first evaporator 32*a* having an outlet coupled to the inlet of the liquid separator 28 and the junction device 26 has a third port as a second inlet coupled to an outlet of the evaporator 32*b* with the evaporator 32*b* having an inlet that is coupled to the outlet of the pump 30. A thermal load 34*a* is coupled to the evaporator 32*a* and a thermal load 34*b* is coupled to the evaporator 32*b*. The evaporators 32*a*, 32*b* are configured to extract heat from the respective loads 34*a*, 34*b* that are in contact with the corresponding evaporators 32*a*, 32*b*. Conduits 24*a*-24*k* couple the various aforementioned items as shown. In addition, a portion 39*d* of the OCRSP 10*d* is demarked by a phantom box, which will be used in the discussion of FIG. 8D.

An operating advantage of the OCRSP 10*d* is that by placing evaporators 32*a*, 32*b* at both the outlet and the second inlet of the junction device 26, it is possible to combine loads which require operation in two-phase region (maintain vapor quality below 1) and which allow operation with a superheat.

The OCRSP 10*d* can also be viewed as including three circuits. The first circuit 15*a* being the refrigerant flow path as in FIG. 1 and two circuits 15*b*" and 15*c*. Circuit 15*b*" being upstream and downstream from the liquid separator 28, carrying liquid from the liquid outlet of the liquid separator 28 and carrying vapor/liquid from the evaporator 32*a* into the inlet of the liquid separator 28. The downstream circuit 15*c* exhausts vapor via the back pressure regulator 29 to the exhaust line 27.

Figure 5:
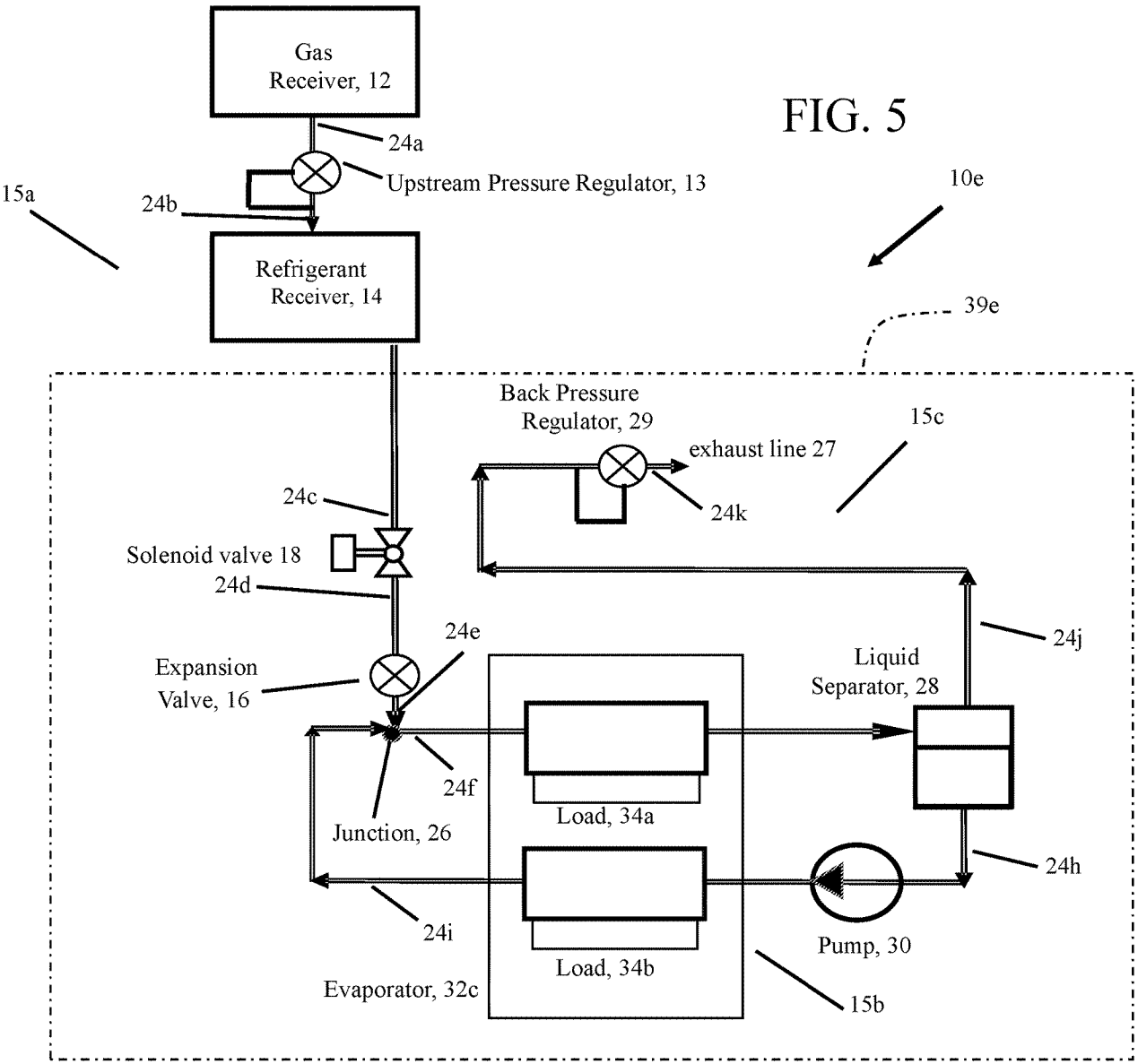
FIG. 5 is a schematic diagram of an example of the OCRSP with a single evaporator coupled upstream and downstream from a liquid separator.

Referring now to FIG. 5, the system 10 can include another alternative open circuit refrigeration system with pump (OCRSP) 10*e*. OCRSP 10*e* includes the first receiver 12, the pressure regulator 13, and the second receiver 14, expansion valve 16, and solenoid control valve 18, pump 30, liquid separator 28, and back pressure regulator 29, coupled to the exhaust line 27, as discussed above.

The OCRSP 10*e* also includes a single evaporator 32*c* that is attached downstream from and upstream of the junction device 26. A first thermal load 34*a* is coupled to the evaporator 32*c*. The evaporator 32*c* is configured to extract heat from the first load 34*a* that is in contact with the evaporator 32*c*. A second thermal load 34*b* is also coupled to the evaporator 32*c*. The evaporator 32*c* is configured to extract heat from the second load 34*a* that is in contact with the evaporator 32*c*. The evaporator 32*c* has a first inlet that is coupled to the outlet 26*c* of the junction device 26 and a first outlet that is coupled to the inlet 28*a* of the liquid separator 28. The evaporator 32*c* has a second inlet that is coupled to the outlet of the pump 30 and has a second outlet that is coupled to the inlet 26*b* of the junction device 26. The second outlet 28*b* (liquid side outlet) of the liquid separator 28 is coupled via the back pressure regulator 29 to the exhaust line 27. Conduits 24*a*-24*k* couple the various aforementioned items, as shown. In addition, a portion 39*e* of the OCRSP 10*e* is demarked by a phantom box, which will be used in the discussion of FIG. 8E.

In this embodiment, the single evaporator 32*c* is attached downstream from and upstream of the junction 26 and requires a single evaporator in comparison with the configuration of FIG. 4 having the two evaporators 32*a*, 32*b* (FIG. 4).

The OCRSP 10*e* can also be viewed as including the three circuits 15*a*, 15*b*" and 15*c* as described in FIG. 4.

Figure 6:
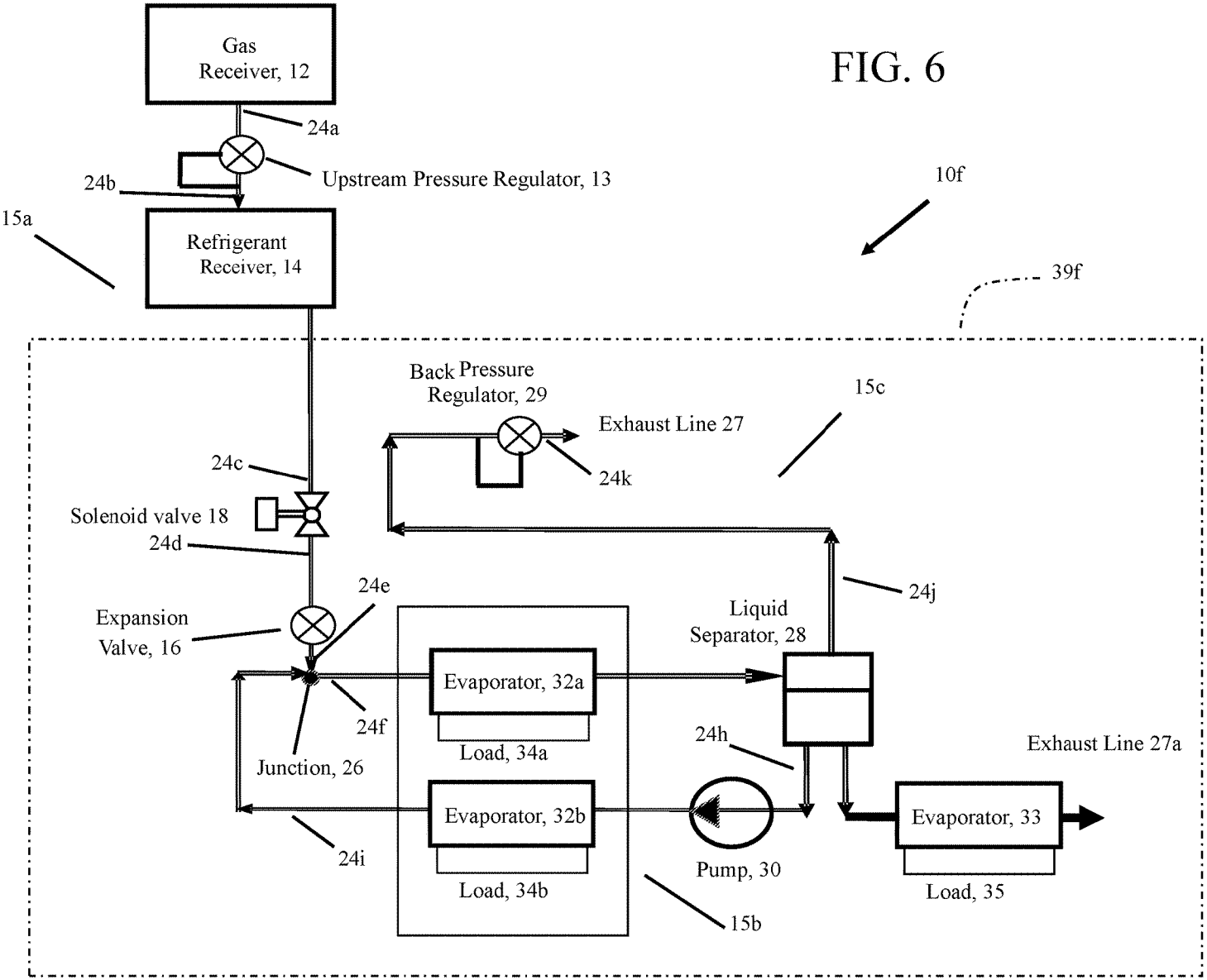
FIG. 6 is a schematic diagram of an example the OCRSP with two evaporators attached downstream from and upstream of the liquid separator, and with a third evaporator.

Referring now to FIG. 6, the system 10 includes an alternative open circuit refrigeration system with pump (OCRSP) 10*f* OCRSP 10*f* includes the first receiver 12, the pressure regulator 13, and the second receiver 14, expansion valve 16, and solenoid control valve 18, pump 30, liquid separator 28, and back pressure regulator 29 coupled to the exhaust line 27, as discussed above. The OCRSP 10*f* also includes the evaporators 32*a*, 32*b* (or can be a single evaporator as in FIG. 5). The evaporators 32*a*, 32*b* have the first thermal load 34*a* and the second thermal load coupled to the evaporators 32*a*, 32*b* respectively, with the evaporators 32*a*, 32*b* configured to extract heat from the loads 34*a*, 34*b* in contact with the evaporators 32*a*-32*b*. Conduits 24*a*-24*m* couple the various aforementioned items, as shown. In addition, a portion 39*f* of the OCRSP 10*f* is demarked by a phantom box, which will be used in the discussion of FIG. 8F.

In this embodiment, the OCRSP 10*e* also has the liquid separator 28 configured to have a second outlet (such a function could be provided with another junction device). The second outlet diverts a portion of the liquid exiting the liquid separator 28 into a third evaporator 33 that is in thermal contact with a load 35 and which extracts heat from the load and exhausts vapor from a second vapor exhaust line 27*a*.

An operating advantage of the OCRSP 10*f* is that by placing evaporators 32*a*, 32*b* at both the outlet and the second inlet of the junction device 26, it is possible to run the evaporators 32*a*, 32*b* with changing refrigerant rates through the junction device 26 to change at different temperatures or change recirculating rates. By using the evaporators 32*a*, 32*b*, the configuration reduces vapor quality at the outlet of the evaporator 32*b* and thus increases circulation rate, as the pump 30 would be 'pumping' less vapor and more liquid. That is, with OCRSP 10*d* the evaporator 32*b* is downstream from the pump 30 and better refrigerant distribution could be provided with this component configuration since liquid refrigerant enters the evaporator 32*b* rather than a liquid/vapor stream as could be for the evaporator 32*a*.

In addition, some heat loads that may be cooled by an evaporator in the superheated phase region, at the same time do not need to actively control superheat. The open circuit refrigeration system 10*e* employs the additional evaporator circuit 33, with an evaporator cooling heat loads in two-phase and superheated regions. The exhaust lines may or may not be combined. The third evaporator 33 can be fed a portion of the liquid refrigerant and operate in superheated region without the need for active superheat control.

The OCRSP 10*f* can also be viewed as including the three circuits 15*a*, 15*b*" and 15*c* as described in FIG. 4 and a fourth circuit 15*d* being the evaporator 33 and exhaust line 27*a*.

Figure 7:
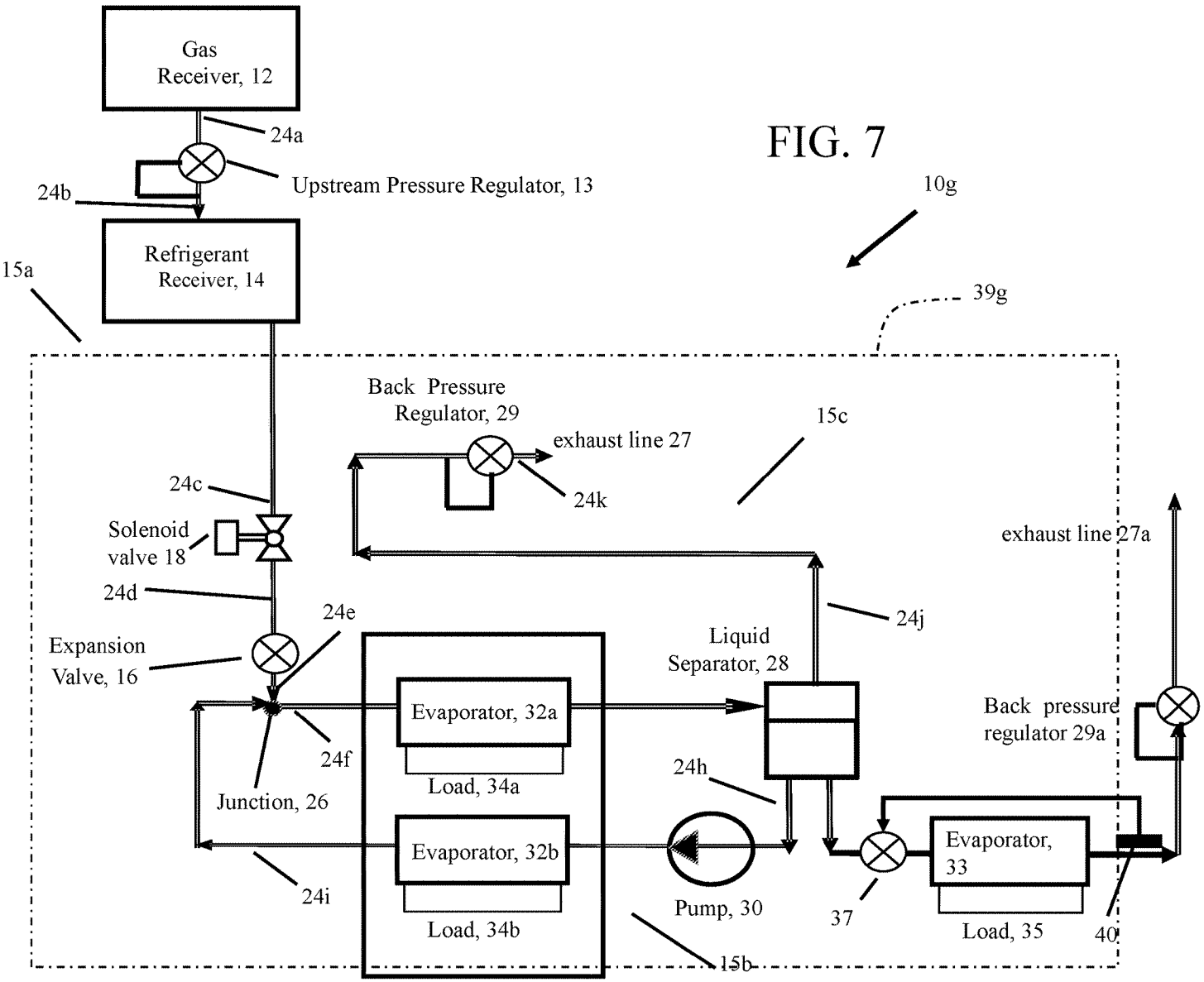
FIG. 7 is a schematic diagram of an example the OCRSP with two evaporators attached downstream from and upstream of the liquid separator and with a third evaporator with superheat control.

Referring now to FIG. 7, the system 10 includes an alternative open circuit refrigeration system with pump (OCRSP) 10*g*. OCRSP 10*g* includes the first receiver 12, the pressure regulator 13, and the second receiver 14, expansion valve 16, and solenoid control valve 18, pump 30, liquid separator 28, and back pressure regulator 29 coupled to the exhaust line 27, as discussed above.

In this embodiment, the OCRSP 10*e* also has the liquid separator 28 configured to have a second outlet (such a function could be provided with another junction device). The second outlet diverts a portion of the liquid exiting the liquid separator 28 into a third evaporator 33 that is in thermal contact with a load 35 and which extracts heat from the load and exhausts vapor from a second vapor exhaust line 27*a*.

The OCRSP 10*g* also includes the evaporators 32*a*, 32*b* (or single evaporator as in FIG. 5), as discussed above. OCRSP 10*g* also includes the third evaporator 33 and a second expansion device 38 having an inlet coupled to the second outlet of the liquid separator 28 and having an outlet coupled to the inlet to the evaporator 33. OCRSP 10*g* also includes a sensor device 40. The sensor 40 disposed approximate to the outlet of the evaporator 34 provides a measurement of superheat, and indirectly, vapor quality. For example, sensor 40 is a combination of temperature and pressure sensors that measure the refrigerant fluid superheat downstream from the heat load, and transmits the measurements to the controller (not shown). The controller adjusts the expansion valve device 37 based on the measured superheat relative to a superheat set point value. By doing so, controller indirectly adjusts the vapor quality of the refrigerant fluid emerging from evaporator 33. Conduits 24*a*-24*m* couple the various aforementioned items, as shown. In addition, a portion 39*g* of the OCRSP 10*g* is demarked by a phantom box, which will be used in the discussion of FIG. 8G.

The evaporators 32*a*, 32*b* operate in two phase (liquid/gas) and the third evaporator 33 operates in superheated region with controlled superheat. OCRSP 10*g* includes the controllable expansion device 37. The expansion valve 37 has a control port that is fed from a sensor 40 or controller (not shown), which control the expansion valve 37 and provide a mechanism to measure and control superheat.

The OCRSP 10*g* can also be viewed as including the three circuits 15*a*, 15*b*" and 15*c* as described in FIG. 4 and a fourth circuit 15*d* being the evaporator 33 and exhaust line 27*a*.

FIGS. 8A to 8G show the system with a different family of alternative open circuit refrigeration system with pump (OCRSP) configurations 11*a*-11*g*.

Figure 8A:
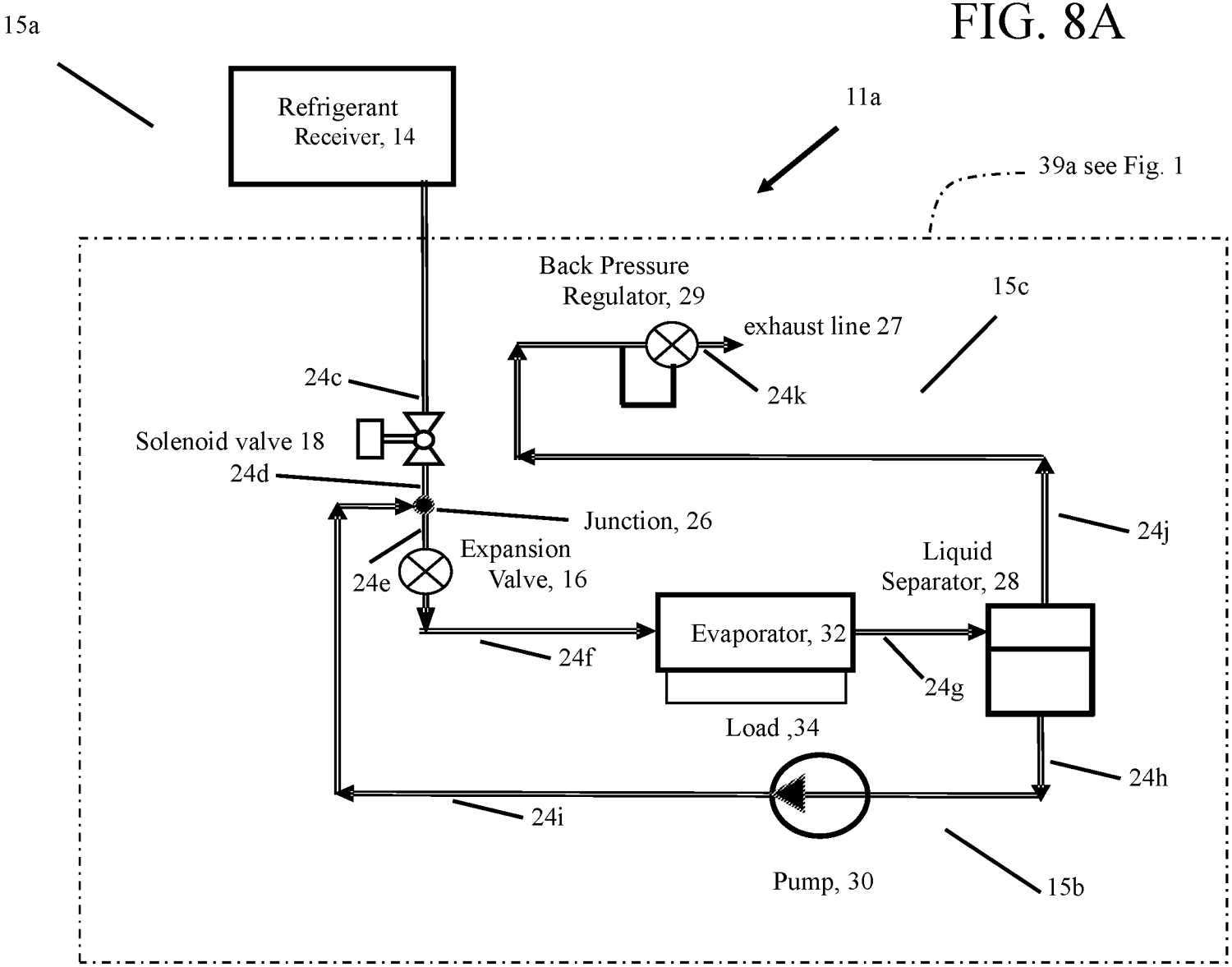
FIGS. 8A-8G are schematic diagrams of examples of a thermal management system that include embodiments of the OCRSP but without a gas receiver.
Figure 8B:
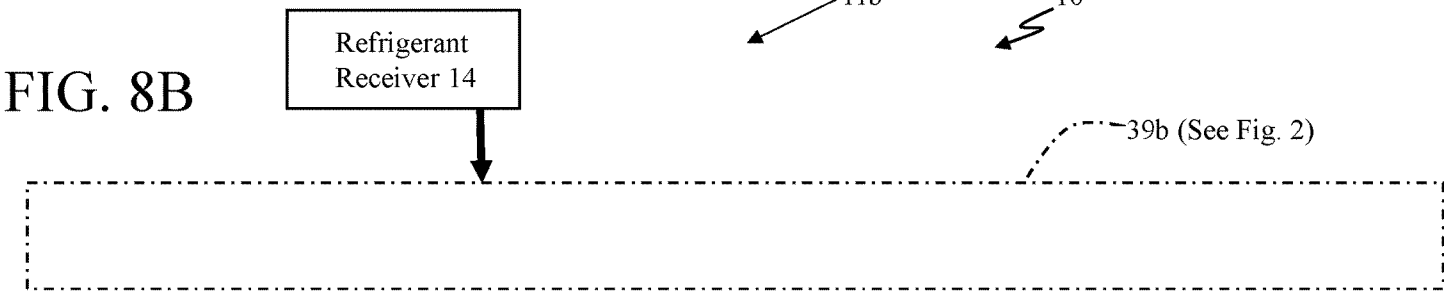
Figure 8C:
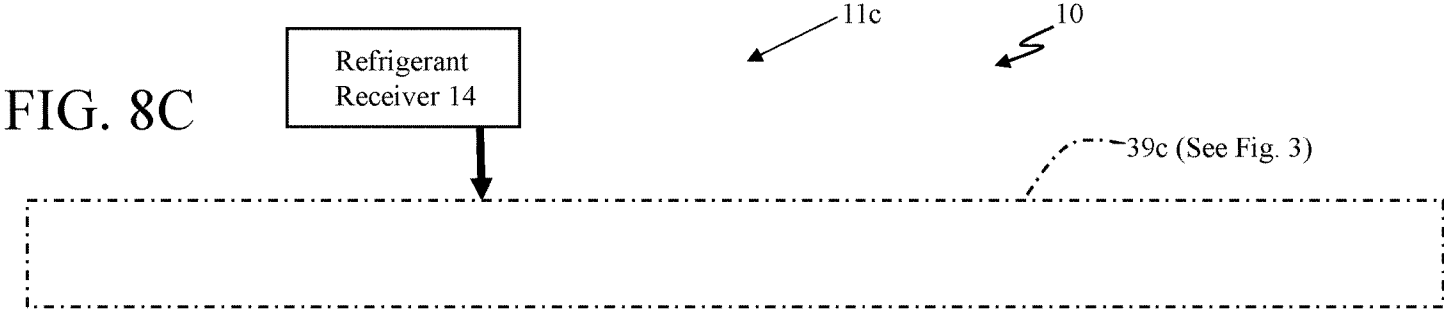
Figure 8D:
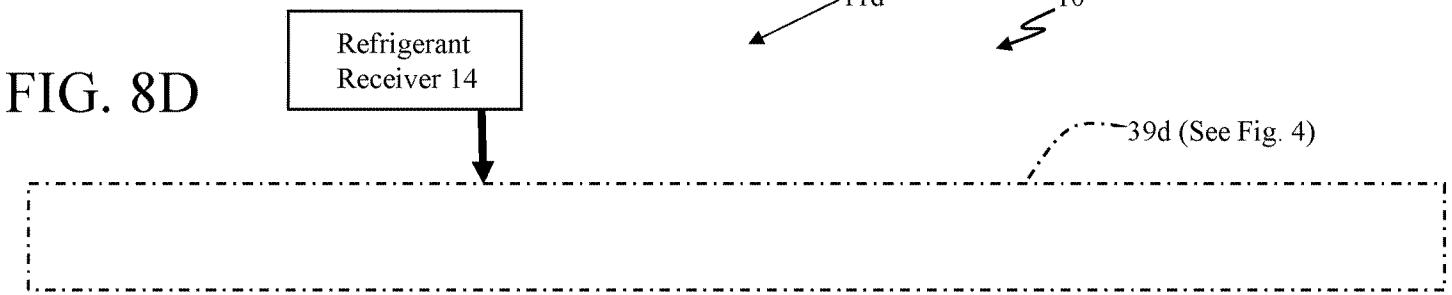
Figure 8E:
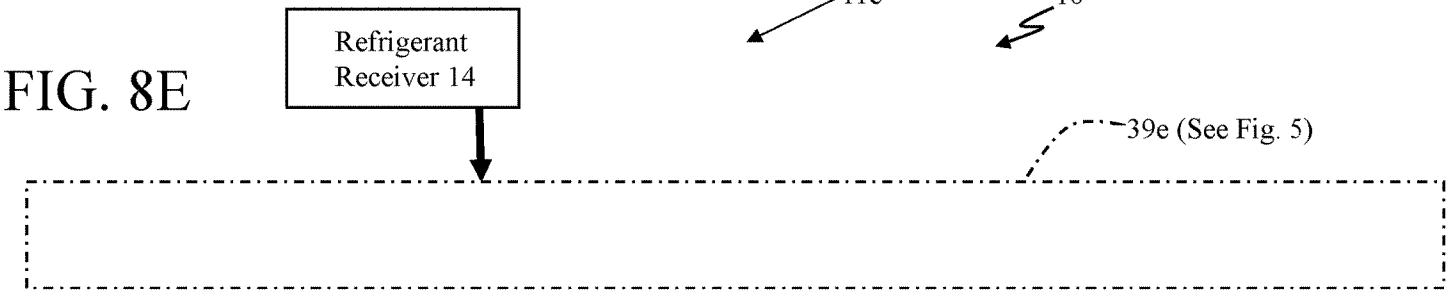
Figure 8F:
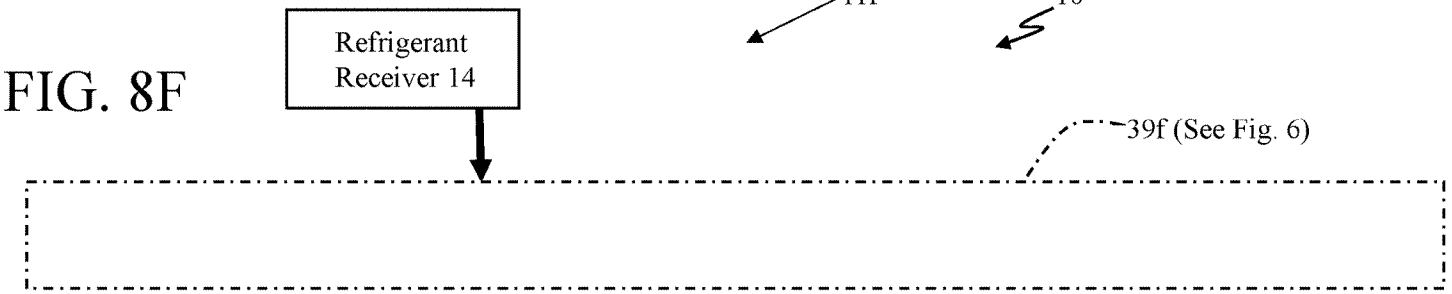
Figure 8G:
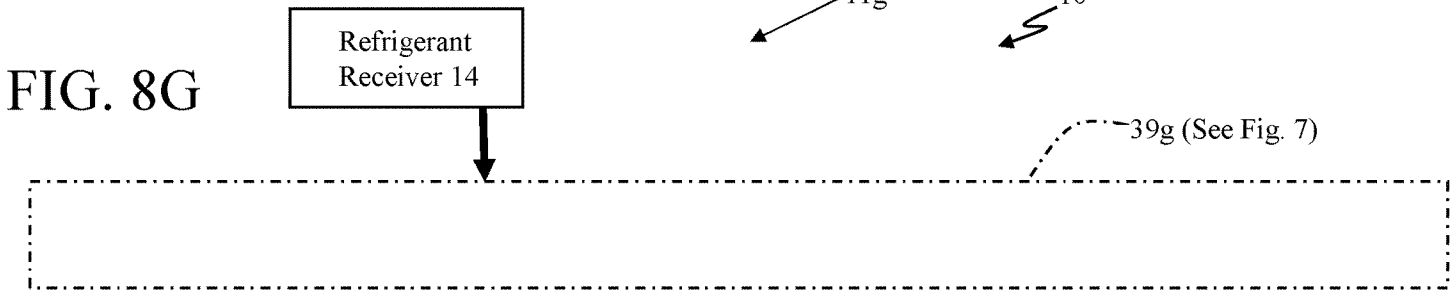

Referring now to FIG. 8A, the open circuit refrigeration system with pump (OCRSP) configuration 11*a*, is shown. OCRSP 11*a* is similar to OCRSP 10*a* (FIG. 1) except that OCRSP 11*a* does not include the first receiver 12 (FIG. 1) or the control device 13 of FIG. 1. The open circuit refrigeration system with pump (OCRSP) 11*a* includes the receiver 14 that receives and is configured to store refrigerant. OCRSP 11*a* can also include the optional solenoid valve 18 and the optional expansion device 16, as discussed above (e.g., for portion 39*a* of FIG. 1). The OCRSP 11*a* also includes junction device 26 coupled between the solenoid valve 18 and expansion device 16, as in FIG. 1. Other configurations of the OCRSP without the first receiver can be provided similar to those of FIGS. 2-7. For OCRSP 11*a*, the configuration and the operation is otherwise similar to that of FIG. 1, except that there is no supply of gas to maintain pressure in the receiver 14. The OCRSP 11*a* can also be viewed as including the three circuits 15*a*, 15*b* and 15*c*, as described in FIG. 1. Each of the embodiments of the OCRSP, as described above in FIGS. 2-7 thus has an analogous configuration that omits the first receiver 12 and pressure regulator 13.

Pressure in the ammonia receiver will change during operation since there is no gas receiver controlling the pressure. This complicates the control function of the expansion valve 16 which receives the refrigerant flow at reducing pressure. For example, in some embodiments, control device 16 is adjusted (e.g., automatically or by controller 72 FIG. 15) based on a measurement of the evaporation pressure (pe) of the refrigerant fluid and/or a measurement of the evaporation temperature of the refrigerant fluid. With first control device 16 adjusted in this manner, second control device 29 can be adjusted (e.g., automatically or by controller 72) based on measurements of one or more of the following system parameter values: the pressure drop across first control device 16, the pressure drop across evaporator 32, the refrigerant fluid pressure in receiver 12, the vapor quality of the refrigerant fluid emerging from evaporator 32 (or at another location in the system), the superheat value of the refrigerant fluid, and the temperature of thermal load 34.

In certain embodiments, first control device 16 is adjusted (e.g., automatically or by controller 72) based on a measurement of the temperature of thermal load 34. With first control device 16 adjusted in this manner, second control device 29 can be adjusted (e.g., automatically or by controller 72) based on measurements of one or more of the following system parameter values: the pressure drop across first control device 16, the pressure drop across evaporator 32, the refrigerant fluid pressure in receiver 12, the vapor quality of the refrigerant fluid emerging from evaporator 32 (or at another location in the system), the superheat value of the refrigerant fluid, and the evaporation pressure (pe) and/or evaporation temperature of the refrigerant fluid.

In some embodiments, controller 72 second control device 29 based on a measurement of the evaporation pressure pe of the refrigerant fluid downstream from first control device 16 (e.g., measured by sensor 604 or 606) and/or a measurement of the evaporation temperature of the refrigerant fluid (e.g., measured by sensor 614). With second control device 29 adjusted based on this measurement, controller 72 can adjust first control device 16 based on measurements of one or more of the following system parameter values: the pressure drop (pr-pe) across first control device 16, the pressure drop across evaporator 32, the refrigerant fluid pressure in receiver 12 (*pr*), the vapor quality of the refrigerant fluid emerging from evaporator 32 (or at another location in the system), the superheat value of the refrigerant fluid in the system, and the temperature of thermal load 34.

In certain embodiments, controller 72 adjusts second control device 29 based on a measurement of the temperature of thermal load 34 (e.g., measured by a sensor). Controller 72 can also adjust first control device 16 based on measurements of one or more of the following system parameter values: the pressure drop ($p_r$-$p_e$) across first control device 16, the pressure drop across evaporator 32, the refrigerant fluid pressure in receiver 12 ($p_r$), the vapor quality of the refrigerant fluid emerging from evaporator 32 (or at another location in the system), the superheat value of the refrigerant fluid in the system, the evaporation pressure ($p_e$) of the refrigerant fluid, and the evaporation temperature of the refrigerant fluid.

To adjust either first control device 16 or second control device 29 based on a particular value of a measured system parameter value, controller 72 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), controller 72 adjusts first control device 16 and/or second control device 29 to adjust the operating state of the system, and reduce the system parameter value.

Certain set point values represent a minimum allowable value of a system parameter, and if the measured value is equal to the set point value (or differs from the set point value by 10% or less (e.g., 5% or less, 3% or less, 1% or less) of the set point value), controller 72 adjusts first control device 16 and/or second control device 29 to adjust the operating state of the system, and increase the system parameter value.

Some set point values represent "target" values of system parameters. For such system parameters, if the measured parameter value differs from the set point value by 1% or more (e.g., 3% or more, 5% or more, 10% or more, 20% or more), controller 72 adjusts first control device 16 and/or second control device 29 to adjust the operating state of the system, so that the system parameter value more closely matches the set point value.

Measured parameter values are assessed in relative terms based on set point values (i.e., as a percentage of set point values). Alternatively, in some embodiments, measured parameter values can be accessed in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then controller 72 adjusts first control device 16 and/or second control device 29 to adjust the operating state of the system, so that the measured system parameter value more closely matches the set point value.

A variety of mechanical connections can be used to attach thermal loads to evaporators and heat exchangers, including (but not limited to) brazing, clamping, welding, etc.

A variety of different refrigerant fluids can be used in any of the OCRSP configurations. For open circuit refrigeration systems in general, emissions regulations and operating environments may limit the types of refrigerant fluids that can be used. For example, in certain embodiments, the refrigerant fluid can be ammonia having very large latent heat; after passing through the cooling circuit, vaporized ammonia that is captured at the vapor port of the liquid separator can be disposed of by incineration, by chemical treatment (i.e., neutralization), and/or by direct venting to the atmosphere. Any liquid captured in the liquid separator is recycled back into the OCRSP (either directly or indirectly).

Since liquid refrigerant temperature is sensitive to ambient temperature, the density of liquid refrigerant changes even though the pressure in the receiver 14 remains the same. Also, the liquid refrigerant temperature impacts the vapor quality at the evaporator inlet. Therefore, the refrigerant mass and volume flow rates change and the control devices 13, 16 and 29 can be used.

Figure 9:
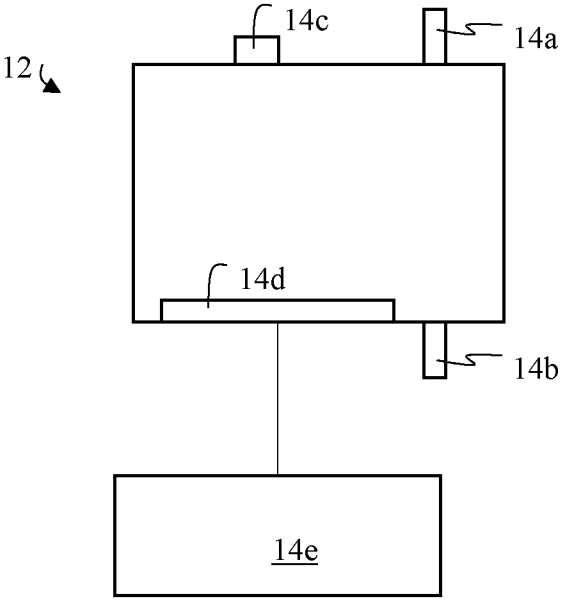
FIG. 9 is a schematic diagram of an example of a receiver for refrigerant fluid in the thermal management system.

Referring now to FIGS. 8B to 8G, these figures show systems 11*b*-11*g* that are analogs to the systems 10*b*-10*g* (FIGS. 2-7), as discussed above. Systems 11*b*-11*g* are constructed similar to and would operate similar as systems 10*b*-10*g* (FIGS. 2-7), but taking into consideration the absence of the gas receivers as in the systems 10*b*-10*g*. Each of these systems 11*b*-11*g* include the portions 39*b*-39*g* denoted in FIGS. 2-7, respectively. In the interests of brevity, the details of these systems 11*b*-11*g* are not discussed here, but the reader is referred to the analogous discussion of systems 10*b*-10*g* (FIGS. 2-7), above and as applicable the discussion of FIG. 8A. FIG. 9 shows a schematic diagram of an example of receiver 14 (or receiver 12).

Receiver 14 includes an inlet port 14*a*, an outlet port 14*b*, and a pressure relief valve 14*c*. To charge receiver 14, refrigerant fluid is typically introduced into receiver 14 via inlet port 14*a*, and this can be done, for example, at service locations. Operating in the field the refrigerant exits receiver 14 through outlet port 14*b* that is connected to conduit 24*a* (FIG. 1). In case of emergency, if the fluid pressure within receiver 14 exceeds a pressure limit value, pressure relief valve 14*c* opens to allow a portion of the refrigerant fluid to escape through valve 14*c* to reduce the fluid pressure within receiver 14. When ambient temperature is very low and, as a result, pressure in the receiver is low and insufficient to drive refrigerant fluid flow through the system, the gas from the gas receiver 126 is used to compress liquid refrigerant in the receiver 12. The gas pressure supplied by the gas receiver 126 compresses liquid refrigerant in the receiver 12 and maintains the liquid refrigerant in a sub-cooled state even at high ambient and liquid refrigerant temperatures.

In general, receiver 14 can have a variety of different shapes. In some embodiments, for example, the receiver is cylindrical. Examples of other possible shapes include, but are not limited to, rectangular prismatic, cubic, and conical. In certain embodiments, receiver 14 can be oriented such that outlet port 14*b* is positioned at the bottom of the receiver. In this manner, the liquid portion of the refrigerant fluid within receiver 14 is discharged first through outlet port 14*b*, prior to discharge of refrigerant vapor. In certain embodiments, the refrigerant fluid can be an ammonia-based mixture that includes ammonia and one or more other substances. For example, mixtures can include one or more additives that facilitate ammonia absorption or ammonia burning.

More generally, any fluid can be used as a refrigerant in the open circuit refrigeration systems disclosed herein, provided that the fluid is suitable for cooling heat load 34*a* (e.g., the fluid boils at an appropriate temperature) and, in embodiments where the refrigerant fluid is exhausted directly to the environment, regulations and other safety and operating considerations do not inhibit such discharge.

Figure 10A:
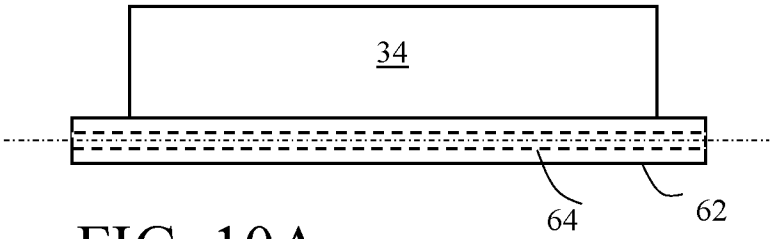
FIGS. 10A and 10B are schematic diagrams showing side and end views, respectively, of an example of the thermal load that includes refrigerant fluid channels.
Figure 10B:
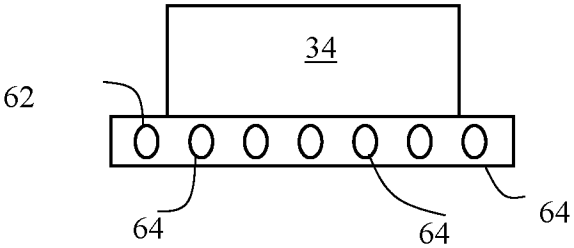

FIGS. 10A and 10B show side and end views, respectively, of a heat load 34 on a thermally conductive body 62 with one or more integrated refrigerant fluid channels 64. The body 62 supporting the heat load 34, which has the refrigerant fluid channel(s) 62 effectively functions as the evaporator 32 for the system. The thermally conductive body 62 can be configured as a cold plate or as a heat exchanging element (such as a mini-channel heat exchanger). Alternatively, the heat loads 34 can be attached to both sides of the thermally conductive body During operation of system 10, cooling can be initiated by a variety of different mechanisms. In some embodiments, for example, system 10 includes a temperature sensor attached to load 34. When the temperature of load 34 exceeds a certain temperature set point (i.e., threshold value), a controller (FIG. 15) connected to the temperature sensor can initiate cooling of load 34. Alternatively, in certain embodiments, system 10 operates essentially continuously—provided that the refrigerant fluid pressure within receiver 14 is sufficient—to cool load 34. As soon as receiver 14 is charged with refrigerant fluid, refrigerant fluid is ready to be directed into evaporator 32 to cool load 34. In general, cooling is initiated when a user of the system 10 or the heat load 34 issues a cooling demand.

Upon initiation of a cooling operation (using the OCRSP 10*b* FIG. 2, as an example), refrigerant fluid from receiver 14 is discharged from the outlet of the receiver 14 and transported through conduit 24*c*, solenoid valve 18 and expansion valve 16 into junction 26. Once inside the expansion valve 16, the refrigerant expands into a liquid/vapor stream that is fed to the junction 26. The expanded refrigerant fluid from the expansion valve 16 is combined within the junction 26 with refrigerant fluid (liquid) from the pump 30 and the combined fluid is outputted to the evaporator 32. When OCRSP 10*b* is activated liquid refrigerant fills the evaporator 32 and liquid separator 28. The evaporator 32 is configured such that the refrigerant fluid undergoes constant enthalpy expansion from an initial pressure $p_r$ (i.e., the receiver pressure) to an evaporation pressure $p_e$ at the outlet of the evaporator 32. In general, the evaporation pressure $p_e$ depends on a variety of factors, most notably the desired temperature set point value (i.e., the target temperature) at which load 34 is to be maintained and the heat input generated by the heat load.

The initial temperature in the receiver 14 tends to be in equilibrium with the surrounding temperature, and the initial temperature established initial pressure is different for different refrigerants. The pressure in the evaporator 32 depends on the evaporating temperature, which is lower than the heat load temperature, and is defined during design of the system, as well as subsequent recirculation of refrigerant from the pump 30. The system 10 is operational as long the receiver-to-evaporator pressure difference is sufficient to drive adequate refrigerant fluid flow through the evaporator 32.

At some point the first or gas receiver 12 feeds gas via pressure regulator 13 and conduits 24*a*, 24*b* into the second or refrigerant receiver 14. The gas flow can occur at activation of the OCRSP 10*b* or can occur at some point after activation of the OCRSP 10*b*. Similar operational factors apply for OCRSP 10*a* and OCRSP's 10*c*-10*g*.

After undergoing expansion in the evaporator 32, the liquid refrigerant fluid is converted to a mixture of liquid and vapor phases at the temperature of the fluid and evaporation pressure $p_e$. The two-phase refrigerant fluid mixture is transported via conduit 24*g* to the liquid separator 28. Liquid from the liquid separator is fed to the pump 30 and is fed back to the junction device 26.

When the two-phase mixture of refrigerant fluid is directed into evaporator 32, the liquid phase absorbs heat from load 34, driving a phase transition of the liquid refrigerant fluid into the vapor phase. Because this phase transition occurs at (nominally) constant temperature, the temperature of the refrigerant vapor/fluid (two-phase) mixture within evaporator 32 remains substantially unchanged, provided at least some liquid refrigerant fluid remains in evaporator 32 to absorb heat.

Further, the constant temperature of the refrigerant (two-phase) mixture within evaporator 32 can be controlled by adjusting the pressure pc of the refrigerant fluid, since adjustment of $p_e$ changes the boiling temperature of the refrigerant fluid. Thus, by regulating the refrigerant fluid pressure $p_e$ upstream from evaporator 32 (e.g., using pressure regulator 13), the temperature of the refrigerant fluid within evaporator 32 (and, nominally, the temperature of heat load 34) can be controlled to match a specific temperature set-point value for load 34, ensuring that load 34 is maintained at, or very near, a target temperature. The pressure drop across the evaporator 32 causes a drop of the temperature of the refrigerant (two-phase) mixture (which is the evaporating temperature), but still the evaporator 32 can be configured to maintain the heat load temperature within in the set tolerances.

In some embodiments, for example, the evaporation pressure of the refrigerant fluid can be adjusted by the back pressure regulator 29 to ensure that the temperature of thermal load 34 is maintained to within ±5 degrees C. (e.g., to within ±4 degrees C., to within ±3 degrees C., to within ±2 degrees C., to within ±1 degree C.) of the temperature set point value for load 34.

As discussed above for OCRSP 10*b*, within evaporator 32, a portion of the liquid refrigerant in the two-phase refrigerant fluid mixture is converted to refrigerant vapor by undergoing a phase change. As a result, the refrigerant fluid mixture that emerges from evaporator 32 has a higher vapor quality (i.e., the fraction of the vapor phase that exists in refrigerant fluid mixture) than the refrigerant fluid mixture that enters evaporator 32. As the refrigerant fluid mixture emerges from evaporator 32, the refrigerant fluid is directed into the liquid separator 28.

The refrigerant vapor emerging from liquid separator 28 is fed to back pressure regulator 29, which directly or indirectly controls the upstream pressure, that is, the evaporating pressure pc in the system. After passing through back pressure regulator 29, the refrigerant fluid is discharged as exhaust vapor through conduit 24*k*, which functions as an exhaust line for system 10. Refrigerant fluid discharge can occur directly into the environment surrounding system 10. Alternatively, in some embodiments, the refrigerant fluid can be further processed; various features and aspects of such processing are discussed in further detail below.

It should be noted that the foregoing, while discussed sequentially for purposes of clarity, occurs simultaneously and continuously during cooling operations. In other words, gas from receiver 12 is continuously being discharged, as needed, into the receiver 14 and the refrigerant fluid is continuously being discharged from receiver 14 into the evaporator 32, continuously being separated into liquid and vapor phases in liquid separator 28, with vapor being exhausted through back pressure regulator 29, while liquid is flowing through pump 30 into the junction and back to the evaporator 32 and from evaporator 32 back into the liquid separator 28. Refrigerant flows continuously through evaporator 32 while thermal load 34 is being cooled.

During operation of system 10, as refrigerant fluid is drawn from receiver 14 and used to cool thermal load 34, the receiver pressure $p_r$ falls. However, this pressure can be maintained by gas from gas receiver 12 (for embodiments 10*a*-10*g*). With either embodiments 10*a*-10*g* or 11*a* (and corresponding analogs), if the refrigerant fluid pressure $p_r$ in receiver 14 is reduced to a value that is too low, the pressure differential $p_r$-$p_e$ may not be adequate to drive sufficient refrigerant fluid mass flow to provide adequate cooling of thermal load 34. Accordingly, when the refrigerant fluid pressure $p_r$ in receiver 14 is reduced to a value that is sufficiently low, the capacity of system 10 to maintain a particular temperature set point value for load 34 may be compromised. Therefore, the pressure in the receiver or pressure drop across the expansion valve 16 (or any related refrigerant fluid pressure or pressure drop in system 10) can be an indicator of the remaining operational time. An appropriate warning signal can be issued (e.g., by the controller) to indicate that in certain period of time, the system may no longer be able to maintain adequate cooling performance; operation of the system can even be halted if the refrigerant fluid pressure in receiver 14 reaches the low-end threshold value.

It should be noted that while in FIGS. 1-8 only a single receiver 14 is shown in each figure, in some embodiments, system 10 can include multiple receivers 14 to allow for operation of the system 10 over an extended time period. Each of the multiple receivers 14 can supply refrigerant fluid to the system 10 to extend to total operating time period. Some embodiments may include plurality of evaporators connected in parallel, which may or may not accompanied by plurality of expansion valves and plurality of evaporators.

The refrigerant fluid that emerges from the vapor side 28*b* of the liquid separator 28 is all or nearly all in the vapor phase. As in OCRSP 10*f*, 10*g*, the refrigerant fluid vapor (at a saturated or very high vapor quality fluid vapor, e.g., about 0.95 or higher) can be directed into a heat exchanger coupled to another thermal load, and can absorb heat from the additional thermal load during propagation through the heat exchanger to cool additional thermal loads as discussed in more detail subsequently.

III. System Operational Control

As discussed in the previous section, by adjusting the pressure pc of the refrigerant fluid, the temperature at which the liquid refrigerant phase undergoes vaporization within evaporator 32 can be controlled. Thus, in general, the temperature of heat load 34 can be controlled by a device or component of system 10 that regulates the pressure of the refrigerant fluid within evaporator 32. Typically, back pressure regulator device 29 (which can be implemented as other types of devices to provide back pressure regulation) adjusts the upstream refrigerant fluid pressure in system 10. Accordingly, back pressure regulator device 29 is generally configured to control the temperature of heat load 34, and can be adjusted to selectively change a temperature set point value (i.e., a target temperature) for heat load 34.

Another system operating parameter is the vapor quality of the refrigerant fluid emerging from evaporator 32. Vapor quality is a number from 0 to 1 and represents the fraction of the refrigerant fluid that is in the vapor phase. Because heat absorbed from load 34 is used to drive a constant-temperature evaporation of liquid refrigerant to form refrigerant vapor in evaporator 32, it is generally important to ensure that, for a particular volume of refrigerant fluid propagating through evaporator 32, at least some of the refrigerant fluid remains in liquid form right up to the point at which the refrigerant exits the evaporator 32 to allow continued heat absorption from the load 34 without causing a temperature increase of the refrigerant fluid. If the fluid is fully converted to the vapor phase after propagating only partially through evaporator 32, further heat absorption by the (now vapor-phase or two-phase with vapor quality above the critical one driving the evaporation process in the dry-out) refrigerant fluid within evaporator 32 will lead to a temperature increase of the refrigerant fluid and heat load 34.

On the other hand, liquid-phase refrigerant fluid that emerges from evaporator 32 represents unused heat-absorbing capacity, in that the liquid refrigerant fluid did not absorb sufficient heat from load 34 to undergo a phase change. To ensure that system 10 operates efficiently, the amount of unused heat-absorbing capacity should remain relatively small and should be defined by the critical vapor quality.

In addition, the boiling heat transfer coefficient that characterizes the effectiveness of heat transfer from load 34 to the refrigerant fluid is typically very sensitive to vapor quality. Vapor quality is a thermodynamic property which is a ratio of mass of vapor to total mass of vapor+liquid. As mentioned above, the "critical vapor quality" is a vapor quality=1. When the vapor quality increases from zero towards the critical vapor quality, the heat transfer coefficient increases. However, when the vapor quality reaches the "critical vapor quality," the heat transfer coefficient is abruptly reduced to a very low value, causing dry out within evaporator 32. In this region of operation, the two-phase mixture behaves as superheated vapor.

In general, the critical vapor quality and heat transfer coefficient values vary widely for different refrigerant fluids, and heat and mass fluxes. For all such refrigerant fluids and operating conditions, the systems and methods disclosed herein control the vapor quality at the outlet of the evaporator such that the vapor quality approaches the threshold of the critical vapor quality.

To make maximum use of the heat-absorbing capacity of the two-phase refrigerant fluid mixture, the vapor quality of the refrigerant fluid emerging from evaporator 32 should nominally be equal to the critical vapor quality. Accordingly, to both efficiently use the heat-absorbing capacity of the two-phase refrigerant fluid mixture and also ensure that the temperature of heat load 34 remains approximately constant at the phase transition temperature of the refrigerant fluid in evaporator 32, the systems and methods disclosed herein are generally configured to adjust the vapor quality of the refrigerant fluid emerging from evaporator 32 to a value that is less than the critical vapor quality.

Another operating consideration for system 10 is the mass flow rate of refrigerant fluid within the system. In open circuit systems with recirculation of non-evaporated liquid the mass flow rate is minimized as long as the system discharges at the highest possible vapor quality, which discharge is defined by liquid separator efficiency.

In summary, the system will operate efficiently and at the same time the temperature of heat load 34 will be maintained within a relatively small tolerance, when the mass flow rate of the refrigerant fluid satisfies the requirement for highest vapor quality.

System 10 is generally configured to control the heat load temperature. vapor quality of the refrigerant fluid emerging from evaporator 32. The evaporator 32 is configured to maintain exit vapor quality below the critical vapor quality. That is for a given set of requirements, e.g., mass flow rate of refrigerant, ambient operating conditions, set point temperature, heat load, desired vapor quality exiting the evaporator, etc., the physical configuration of the evaporate 32 is determined such that the desired vapor quality would be achieved or substantially achieved. This would entail determining a suitable size, e.g., length, width, shape and materials, of the evaporator given the expected operating conditions. Conventional thermodynamic principles can be used to design such an evaporator for a specific set of requirements. In such an instance where the evaporator 32 is configured to maintain exit vapor quality this could eliminate the need for another control device, e.g., at the input to the evaporator 32.

In general, a wide variety of different measurement and control strategies can be implemented in system 10 to achieve the control objectives discussed above. Generally, the control devices 13, 16, 18, 29 and 30 can be controlled by measuring a thermodynamic quantity upon which signals are produced to control and adjust the respective devices. The measurements can be implemented in various different ways, depending upon the nature of the devices and the design of the system. As an example, embodiments can optionally include mechanical devices that are controlled by electrical signals, e.g., solenoid controlled valves, regulators, etc. The signals can be produced by sensors and fed to the devices or can be processed by controllers to produce signals to control the devices. The devices can be purely mechanically controlled as well.

It should generally be understood that various control strategies, control devices, and measurement devices can be implemented in a variety of combinations in the systems disclosed herein. Thus, for example, any of the control devices can be implemented as mechanically-controlled devices. In addition, systems with mixed control in which one of the devices is a mechanically controlled device and others are electronically-adjustable devices can also be implemented, along with systems in which all of the control devices are electronically-adjustable devices that are controlled in response to signals measured by one or more sensors and or by sensor signals processed by controller (e.g., dedicated or general processor) circuits. In some embodiments, the systems disclosed herein can include sensors and/or measurement devices that measure various system properties and operating parameters, and transmit electrical signals corresponding to the measured information.

Figure 11C:
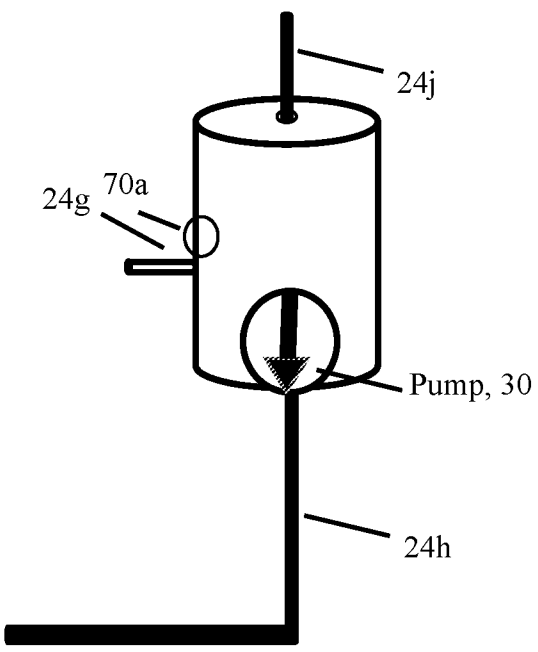
FIGS. 11A-11C are diagrammatical views of different configurations for a liquid separator.
Figure 11B:
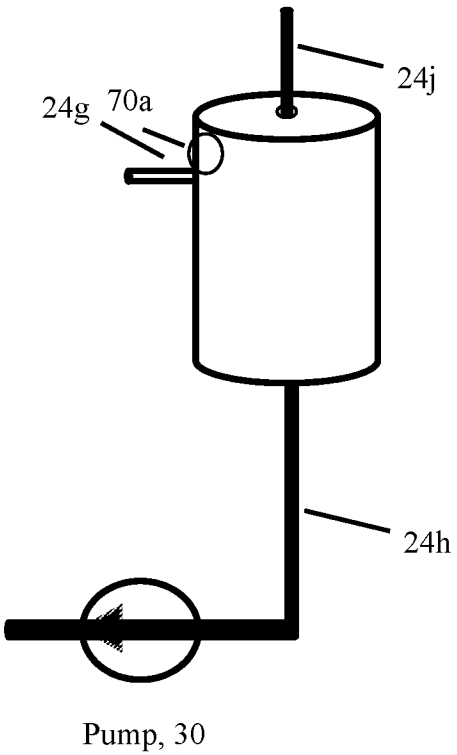
Figure 11A:
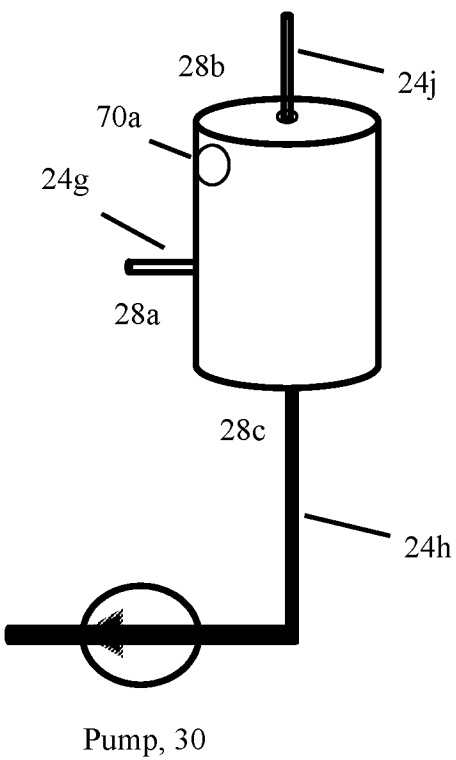

FIGS. 11A-11C depict different configurations for the liquid separator 28 (implemented as a coalescing liquid separator or a flash drum for example)) has ports 28*a*-28*c* coupled to conduits 24*g*, 24*h* and 24*j*, respectively. Other conventional details such as membranes or meshes, etc. are not shown.

In fluid dynamics there exists a physical phenomenon referred to as "cavitation." Cavitation involves the formation and subsequent collapse of vapor cavities in a liquid, i.e., small bubbles that result from a liquid being subjected to rapid and even small changes in pressure. These changes cause the formation of cavities in the liquid in regions at the suction where the pressure is relatively low in comparison to other regions closer to the pump discharge of the liquid. When subjected to higher pressure, these voids can often implode and generate an intense shock wave. This is a significant cause of wear in various components. Common examples of this kind of wear are to pump impellers.

With the use of pump 30 cavitation could exist in the OCRSP 10*a*-10*g* and 11*a*. To eliminate or at least moderate the potential presence of cavitation several strategies can be used. One of the way to reduce the cavitation risk is to increase the static pressure at the pump inlet configuring the liquid separator to maintain high liquid level during operation.

FIGS. 11A-11C depict example configurations of the liquid separator 28 (implemented as a flash drum for example) that has ports 28*a*-28*c* coupled to conduits 24*g*, 24*h* and 24*j*, respectively. In FIG. 11A, the pump 30 is located distal from the liquid separator port 28. This configuration potentially presents the possibility of cavitation. To minimize the possibility of cavitation one of the configurations of FIG. 11B or 11C can be used.

In FIG. 11B, the pump 30 is located distal from the liquid separator port 28, but the height at which the inlet is located is higher than that of FIG. 11A. This would result in an increase in liquid pressure at the outlet 28*c* of the liquid separator 28 and concomitant therewith an increase in liquid pressure at the inlet of the pump 30. Increasing the pressure at the inlet to the pump should minimize possibility of cavitation.

Another strategy is presented in FIG. 11C, where the pump 30 is located proximate to or indeed, as shown, inside of the liquid separator port 28. In addition although not show the height at which the inlet is located can be adjusted to that of FIG. 11B, rather than the height of FIG. 11A as shown in FIG. 11C. This would result in an increase in liquid pressure at the inlet of the pump 30 further minimizing the possibility of cavitation.

Another alternative strategy that can be used for any of the configurations depicted involves the use of a sensor 70*a* that produces a signal that is a measure of the height of a column of liquid in the liquid separator. The signal is sent to a controller that will be used to start the pump 30, once a sufficient height of liquid is contained by the liquid separator 28.

Another alternative strategy that can be used for any of the configurations depicted involves the use of a heat exchanger. The heat exchanger is an evaporator, which brings in thermal contact two refrigerant streams. In the above systems, a first of the streams is the liquid stream leaving the liquid separator 28. A second stream is the liquid refrigerant expanded to a pressure lower than the evaporator pressure in the evaporator 32 and evaporating the related evaporating temperature lower than the liquid temperature at the liquid separator exit. Thus, the liquid from the liquid separator 28 exit is subcooled rejecting thermal energy to the second side of the heat exchanger. The second side absorbs the rejected thermal energy due to evaporating and superheating of the second refrigerant stream.

Figure 12A:
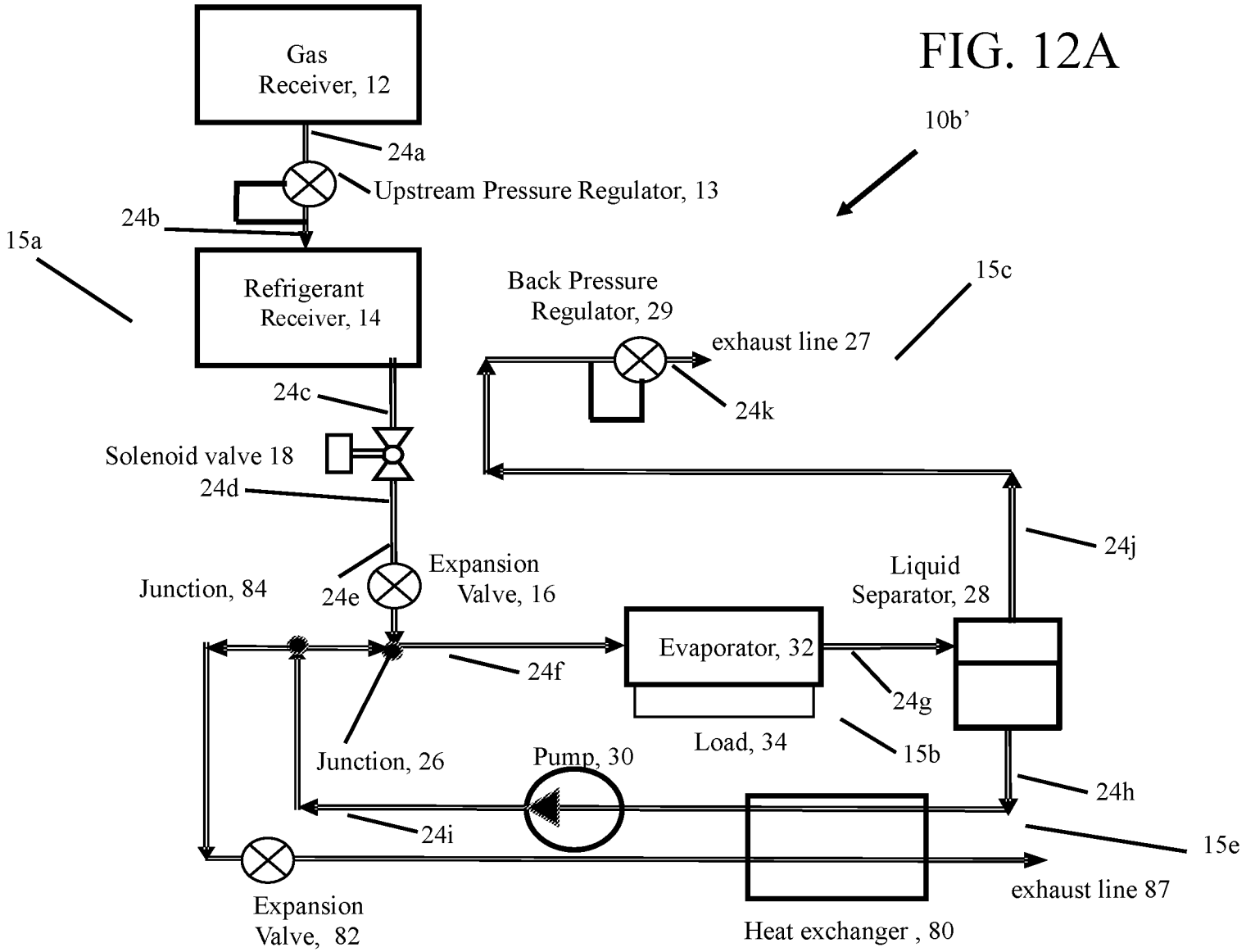
FIGS. 12A and 12B are schematic diagrams of alternative examples of the OCRSP with heat exchangers to control heat at an inlet of the pump.

Referring now to FIG. 12A, the system 10 includes another alternative open circuit refrigeration system with pump configuration 10*b*' that is similar to the open circuit refrigeration system with pump (OCRSP) 10*b* of FIG. 2, including the first receiver 12, the pressure regulator 13, the second receiver 14, the solenoid control valve 18, expansion valve 16, evaporator 32, liquid separator 28, pump 30 and back pressure regulator 29, coupled to the exhaust line 27, as discussed above in FIG. 2. (Alternatively, junction 26 can be located upstream of valve 16 or upstream of valve 16). The OCRSP 10*b*' also includes the junction device 26 having one port as an inlet coupled to the outlet of the pump 30 and the second port as an outlet coupled to the inlet to the evaporator 32, and having the third port as a second inlet coupled to the output of the expansion valve 16, as in FIG. 2. Conduits 24*a*-24*m* couple the various aforementioned items as shown.

The OCRSP 10*b*' also includes a heat exchanger 80 having two fluid paths, a first fluid path between a first inlet and a first outlet of the heat exchanger 80 that is disposed between the pump 30 and the liquid side output of the liquid separator 28. Liquid from the liquid side output of the liquid separator 28 is fed through the first path of the heat exchanger 80 to the pump 30. The heat exchanger 80 has a second fluid path between a second inlet and a second outlet of the heat exchanger 80. The second path is disposed between an expansion valve 82 and an exhaust line 87. A second junction device 84 is interposed between the first junction device 26 and the expansion valve 82, having one port coupled to the input of the first junction device 26, a second port coupled to the expansion valve 82, with both the first and second ports acting as outlets, and with a third port, acting as an inlet coupled to the output of the pump 30.

The OCRSP 10*b*' operates in a similar manner as OCRSP 10*b*, modified as follows: Liquid from the liquid separator at the liquid outlet sided is passed through the heat exchanger 80 that transfers heat from the liquid prior to reaching the pump 30 to a fluid flow that originates from the output of the pump 30, via the junction device 84 and the expansion valve 82. The presence of the heat exchanger 82 increases subcooling at the inlet to the pump 30 and reduces the potential for pump cavitation. The heat exchanger is an alternative to or addition to providing a liquid column at the pump 30 inlet to reduce the potential of cavitation in the pump.

OCRSP 10*b*' can also be viewed as including the three circuits 15*a*, 15*b*" and 15*c*, as described in FIG. 4, and a circuit 15*e* being the heat exchanger 80 and exhaust line 87.

Figure 12B:
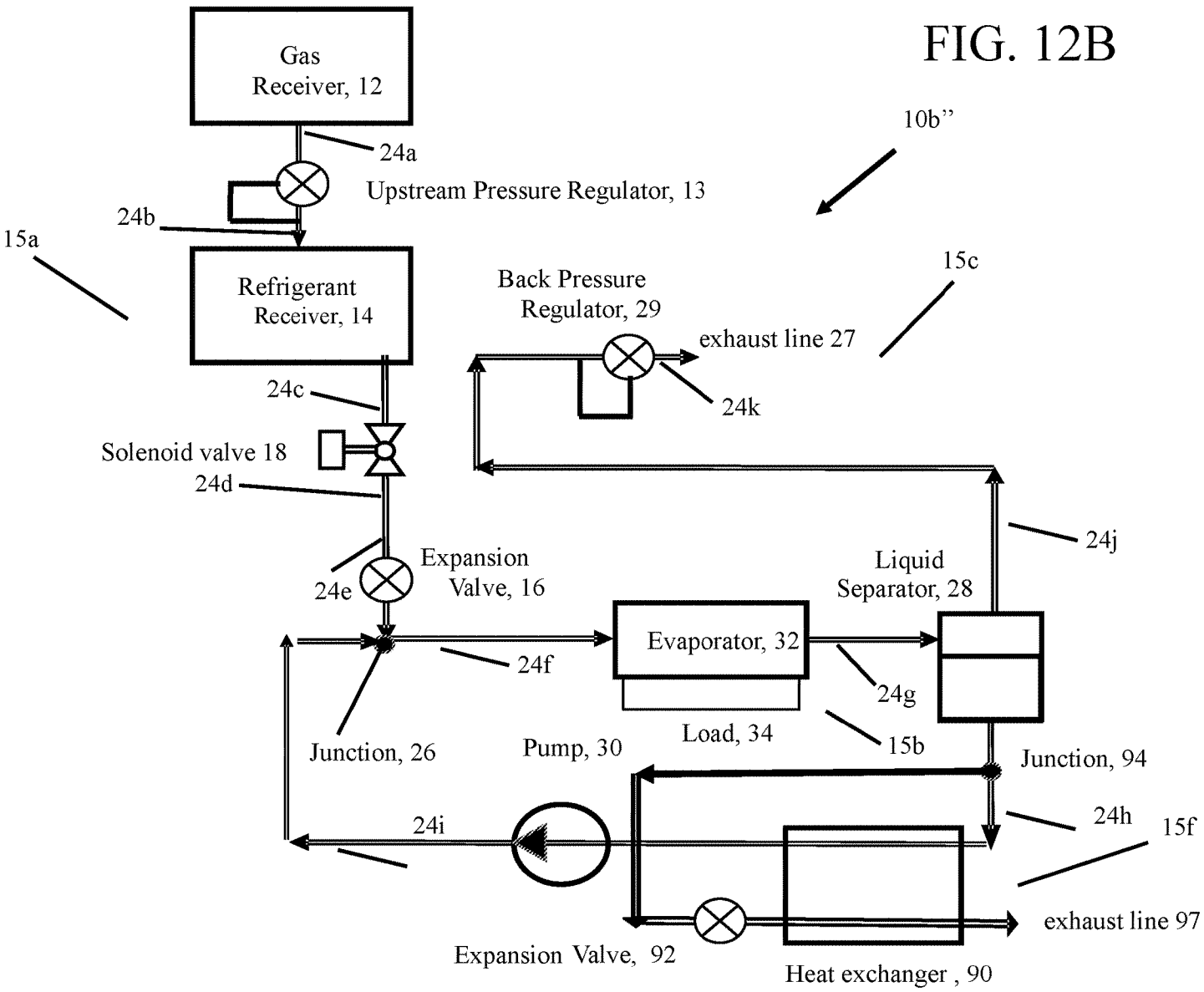

Referring now to FIG. 12B, the system 10 includes another alternative open circuit refrigeration system with pump configuration 10*b*" that is similar to the open circuit refrigeration system with pump (OCRSP) 10*b* of FIG. 2, and OCRSP 10*b*' (FIG. 12A) including the first receiver 12, the pressure regulator 13, the second receiver 14, the solenoid control valve 18, expansion valve 16, evaporator 32, liquid separator 28, pump 30 and back pressure regulator 29, coupled to the exhaust line 27, as discussed above in FIG. 2. The OCRSP 10*b*" also includes the junction device 26 having one port as an inlet coupled to the outlet of the pump 30 and the second port as an outlet coupled to the inlet to the evaporator 32, and having the third port as a second inlet coupled to the output of the expansion valve 16, as in FIG. 2. (Alternatively, as mentioned above the junction 26 can be located upstream of valve 16 or upstream of valve 16). Conduits 24*a*-24*m* couple the various aforementioned items as shown.

The OCRSP 10*b*" also includes a heat exchanger 90 having first and second two fluid paths. The first fluid path is between a first inlet and a first outlet of the heat exchanger 90 that is disposed between the pump 30 and a junction device 94. The junction device 90 has first and second ports coupled between the liquid side output of the liquid separator 28 and the first inlet of the heat exchanger 90. The junction device 90 also has a third port. The heat exchanger 90 has the second fluid path between a second inlet and a second outlet of the heat exchanger 90. The second path is disposed between an expansion valve 92 and an exhaust line 97. The third port of the second junction device 94 is coupled to an inlet of the expansion valve 92 and an outlet of the expansion value 92 is coupled to the second inlet of the heat exchanger 90 with the second outlet of the heat exchanger 90 coupled to the exhaust line 97.

Liquid from the liquid side output of the liquid separator 28 is fed to the first port and a first portion of the liquid is fed through to the second port to the first inlet and into the first path of the heat exchanger 90 to the pump 30, and a second portion of the liquid from the first port of the junction 94 is fed through the third port to the inlet of the expansion valve 92.

The OCRSP 10*b*" operates in a similar manner as OCRSP 10*b*, modified as above and OCRSP 10*b*' as follows: Liquid from the liquid separator at the liquid outlet sided is passed via the junction device 94, through the heat exchanger 90 that transfers heat from the liquid prior to reaching the pump 30 to a fluid flow that originates from the liquid side outlet of the liquid separator 28, via the junction device 94 and the expansion valve 92. The presence of the heat exchanger 82 increases sub-cooling at the inlet to the pump 30 and reduces the potential for pump cavitation. The heat exchanger is an alternative to or addition to providing a liquid column at the pump 30 inlet to reduce the potential of cavitation in the pump.

OCRSP 10*b*" can also be viewed as including the three circuits 15*a*, 15*b*" and 15*c*, as described in FIG. 4, and a circuit 15*f* being the heat exchanger 92 and exhaust line 97.

Figure 13:
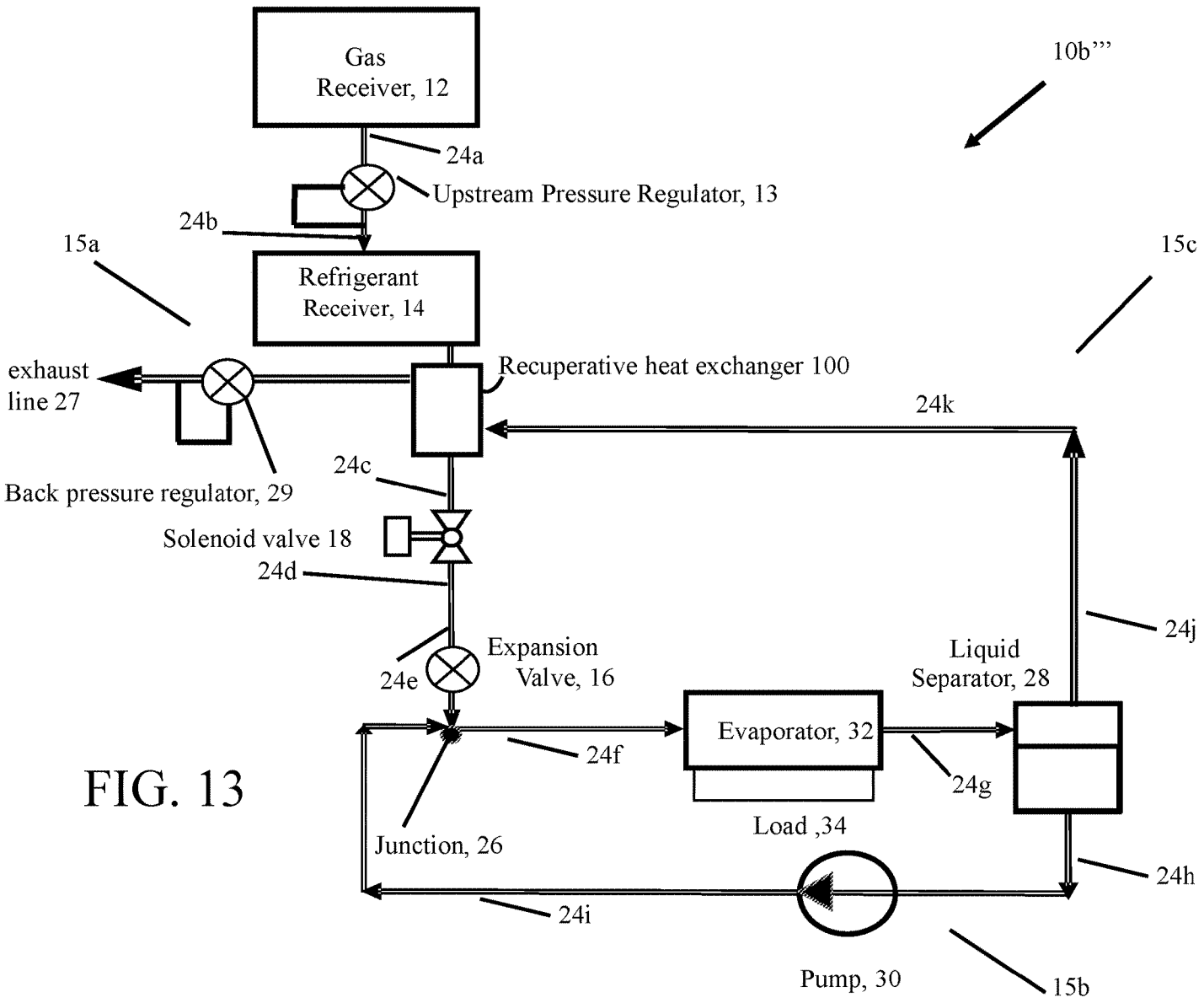
FIG. 13 is a schematic diagram of an alternative example of the OCRSP with a recuperative heat exchanger.

Referring now to FIG. 13, the system 10 includes another alternative open circuit refrigeration system with pump configuration 10*b*'" that is similar to the open circuit refrigeration system with pump (OCRSP) 10*b* of FIG. 2, including the first receiver 12, the pressure regulator 13, the second receiver 14, the solenoid control valve 18, expansion valve 16, evaporator 32, liquid separator 28, pump 30 and back pressure regulator 29, coupled to the exhaust line 27, as discussed above in FIG. 2. The OCRSP 10*b*'" also includes the junction device 26 having one port as an inlet coupled to the outlet of the pump 30 and the second port as an outlet coupled to the inlet to the evaporator 32, and having the third port as a second inlet coupled to the output of the expansion valve 16, as in FIG. 2. Conduits 24*a*-24*m* couple the various aforementioned items as shown.

The OCRSP 10*b*'" also includes a recuperative heat exchanger 100 having two fluid paths. A first fluid path is between a first inlet and first outlet of the recuperative heat exchanger 100. The first fluid path has the first inlet of recuperative heat exchanger 100 coupled to the outlet of the receiver 14 and the first outlet of the recuperative heat exchanger 100 coupled to the inlet of the valve 18. A second fluid path is between a second inlet and second outlet of the recuperative heat exchanger 100. The second fluid path has the second inlet of recuperative heat exchanger 100 coupled to the vapor side outlet of the liquid separator 28 and the second outlet of the recuperative heat exchanger 100 is coupled to the inlet of the back pressure regulator 29. (Alternatively, back pressure regulator 29 can be located upstream from the heat exchanger 100 on the vapor stream.)

In this configuration, the receiver 14 is integrated with the recuperative heat exchanger 100. The recuperative heat exchanger 100 provides thermal contact between the liquid refrigerant leaving the receiver 14 and the refrigerant vapor from the liquid separator 28. The use of the recuperative heat exchanger 100 at the outlet of the receiver 14 may further reduce liquid refrigerant mass flow rate demand from the receiver 14 by re-using the enthalpy of the exhaust vapor to precool the refrigerant liquid entering the evaporator that reduces the enthalpy of the refrigerant entering the evaporator, and thus reduces mass flow rate demand and provides a relative increase in energy efficiency of the system 10.

The OCRSP 10*b*'" with the recuperative heat exchanger 100 can be used with any of the embodiments 10*a*, 10*c*-10*g* or 11*a* (and corresponding analogs).

Figure 13A:
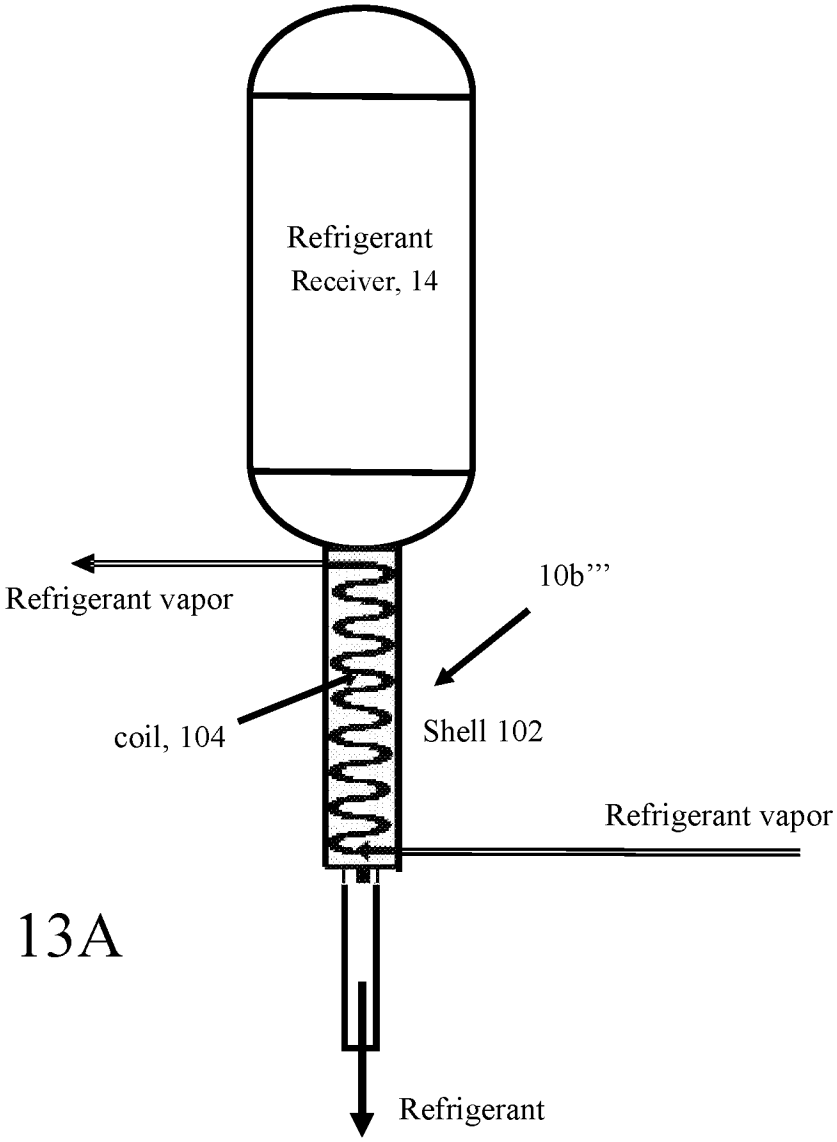
FIG. 13A is a schematic diagram of an example the recuperative heat exchanger of FIG. 13.

Referring now to FIG. 13A, one embodiment of the recuperative heat exchanger 100 is a helical-coil type heat exchanger that includes a shell 102 and a helical coil 104 that is inside the shell 102. The refrigerant liquid stream from the receiver 14 flows though the shell 102 while the vapor stream from the vapor side of the liquid separator flows through the coil 104. The coil 104 can be made of different heat exchanger elements: conventional tubes, mini-channel tubes, cold plate type tubes, etc. The shape of the coil channels can be different as well. Heat from the vapor is transferred from the vapor to the liquid. Other types of tube-in-tube heat exchangers and compact plate heat exchangers may be applicable as well.

Figure 14:
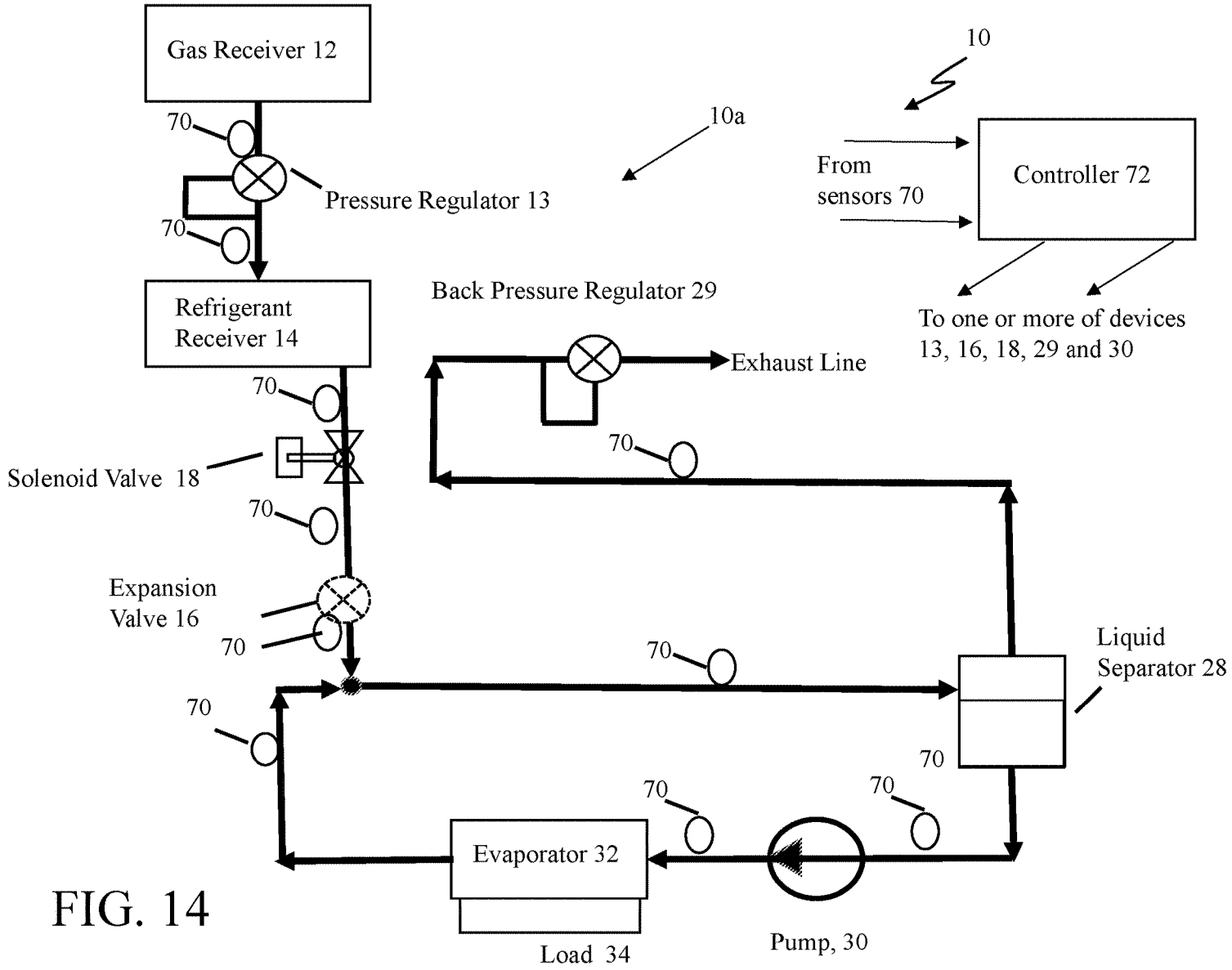
FIG. 14 is a schematic diagram of an example of the thermal management system of FIG. 1 that includes one or more sensors connected to a controller.

FIG. 14 shows the thermal management system 10 of FIG. 2 with a number of different sensors generally 70 each of which is optional, and various combinations of the sensors shown can be used to measure thermodynamic properties of the system 10 that are used to adjust the control devices 13, 16, 18, 29, 30, 82, and/or 92 which signals are processed by a controller 72.

Figure 15:
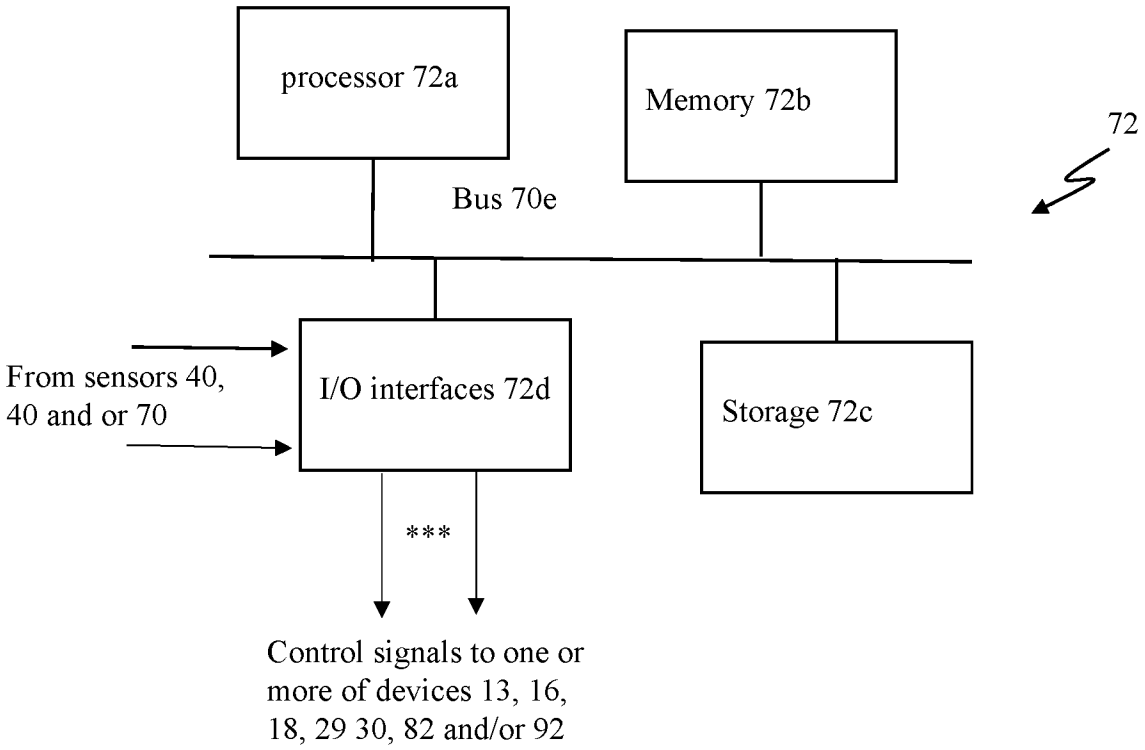
FIG. 15 is a block diagram of a controller.

FIG. 15 shows the controller 72 that includes a processor 72*a*, memory 72*b*, storage 72*c*, and I/O interfaces 72*d*, all of which are connected/coupled together via a bus 70*e*. Any two of the optional devices, as pressure sensors upstream and downstream from a control device can be configured to measure information about a pressure differential $p_r$-$p_e$ across the respective control device and to transmit electronic signals corresponding to the measured pressure from which a pressure difference information can be generated by the controller 72. Other sensors such as flow sensors and temperature sensors can be used as well. In certain embodiments, sensors can be replaced by a single pressure differential sensor, a first end of which is connected adjacent to an inlet and a second end of which is connected adjacent to an outlet of a device to which differential pressure is to be measured, such as the evaporator. The pressure differential sensor measures and transmits information about the refrigerant fluid pressure drop across the device, e.g., the evaporator 32.

Temperature sensors can be positioned adjacent to an inlet or an outlet of e.g., the evaporator 32 or between the inlet and the outlet. Such temperature sensors measure temperature information for the refrigerant fluid within evaporator 32 (which represents the evaporating temperature) and transmits an electronic signal corresponding to the measured information. A temperature sensor can be attached to heat load 34, which measures temperature information for the load and transmits an electronic signal corresponding to the measured information. An optional temperature sensor can be adjacent to the outlet of evaporator 32 that measures and transmits information about the temperature of the refrigerant fluid as it emerges from evaporator 32.

In certain embodiments, the systems disclosed herein are configured to determine superheat information for the refrigerant fluid based on temperature and pressure information for the refrigerant fluid measured by any of the sensors disclosed herein. The superheat of the refrigerant vapor refers to the difference between the temperature of the refrigerant fluid vapor at a measurement point in the system and the saturated vapor temperature of the refrigerant fluid defined by the refrigerant pressure at the measurement point in the system.

To determine the superheat associated with the refrigerant fluid, the system controller 72 (as described) receives information about the refrigerant fluid vapor pressure after emerging from a heat exchanger downstream from evaporator 32, and uses calibration information, a lookup table, a mathematical relationship, or other information to determine the saturated vapor temperature for the refrigerant fluid from the pressure information. The controller 72 also receives information about the actual temperature of the refrigerant fluid, and then calculates the superheat associated with the refrigerant fluid as the difference between the actual temperature of the refrigerant fluid and the saturated vapor temperature for the refrigerant fluid.

The foregoing temperature sensors can be implemented in a variety of ways in system 10. As one example, thermocouples and thermistors can function as temperature sensors in system 10. Examples of suitable commercially available temperature sensors for use in system 10 include, but are not limited to the 88000 series thermocouple surface probes (available from OMEGA Engineering Inc., Norwalk, Conn.).

System 10 can include a vapor quality sensor that measures vapor quality of the refrigerant fluid emerging from evaporator 32. Typically, such a sensor is implemented as a capacitive sensor that measures a difference in capacitance between the liquid and vapor phases of the refrigerant fluid. The capacitance information can be used to directly determine the vapor quality of the refrigerant fluid (e.g., by system controller 72). Alternatively, sensor can determine the vapor quality directly based on the differential capacitance measurements and transmit an electronic signal that includes information about the refrigerant fluid vapor quality. Examples of commercially available vapor quality sensors that can be used in system 10 include, but are not limited to HBX sensors (available from HB Products, Hasselager, Denmark).

The systems disclosed herein can include a system controller 72 that receives measurement signals from one or more system sensors and transmits control signals to the control devices to adjust the refrigerant fluid vapor quality and the heat load temperature.

It should generally understood that the systems disclosed herein can include a variety of combinations of the various sensors described above, and controller 72 can receive measurement information periodically or aperiodically from any of the various sensors. Moreover, it should be understood any of the sensors described can operate autonomously, measuring information and transmitting the information to controller 72 (or directly to the first and/or second control devices), or alternatively, any of the sensors described above can measure information when activated by controller 72 via a suitable control signal, and measure and transmit information to controller 72 in response to the activating control signal.

To adjust a control device on a particular value of a measured system parameter value, controller 72 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), controller 72 adjusts a respective control device to modify the operating state of the system 10. Certain set point values represent a minimum allowable value of a system parameter, and if the measured value is equal to the set point value (or differs from the set point value by 10% or less (e.g., 5% or less, 3% or less, 1% or less) of the set point value), controller 72 adjusts the respective control device to modify the operating state of the system 10, and increase the system parameter value. The controller 72 executes algorithms that use the measured sensor value(s) to provide signals that cause the various control devices to adjust refrigerant flow rates, etc.

Some set point values represent "target" values of system parameters. For such system parameters, if the measured parameter value differs from the set point value by 1% or more (e.g., 3% or more, 5% or more, 10% or more, 20% or more), controller 72 adjusts the respective control device to adjust the operating state of the system, so that the system parameter value more closely matches the set point value.

IV. Additional Features of Thermal Management Systems

The foregoing examples of thermal management systems illustrate a number of features that can be included in any of the systems within the scope of this disclosure. In addition, a variety of other features can be present in such systems.

In certain embodiments, refrigerant vapor fluid that is discharged from the liquid separator 28 can be directly discharged through the back-pressure regulator, as exhaust without further treatment. Direct discharge provides a convenient and straightforward method for handling spent refrigerant, and has the added advantage that over time, the overall weight of the system is reduced due to the loss of refrigerant fluid. For systems that are mounted to small vehicles or are otherwise mobile, this reduction in weight can be important.

In some embodiments, however, refrigerant fluid vapor can be further processed before it is discharged. Further processing may be desirable depending upon the nature of the refrigerant fluid that is used, as direct discharge of unprocessed refrigerant fluid vapor may be hazardous to humans and/or may deleterious to mechanical and/or electronic devices in the vicinity of the system. For example, the unprocessed refrigerant fluid vapor may be flammable or toxic, or may corrode metallic device components. In situations such as these, additional processing of the refrigerant fluid vapor may be desirable.

V. Integration with Power Systems

In some embodiments, the refrigeration systems disclosed herein can combined with power systems to form integrated power and thermal systems, in which certain components of the integrated systems are responsible for providing refrigeration functions and certain components of the integrated systems are responsible for generating operating power. An integrated power and thermal management system can include many features similar to those discussed above, in addition, the system can include an engine with an inlet that receives the stream of waste refrigerant fluid. The engine can combust the waste refrigerant fluid directly, or alternatively, can mix the waste refrigerant fluid with one or more additives (such as oxidizers) before combustion. Where ammonia is used as the refrigerant fluid in system, suitable engine configurations for both direct ammonia combustion as fuel, and combustion of ammonia mixed with other additives, can be implemented. In general, combustion of ammonia improves the efficiency of power generation by the engine. The energy released from combustion of the refrigerant fluid can be used by engine to generate electrical power, e.g., by using the energy to drive a generator.

VI. Start-Up and Temporary Operation

In certain embodiments, the thermal management systems disclosed herein operate differently at, and immediately following, system start-up, compared to the manner in which the systems operate after an extended running period. Upon start-up, refrigerant fluid in receiver 14 may be relatively cold, and therefore the receiver pressure ($p_r$) may be lower than a typical receiver pressure during extended operation of the system. However, if receiver pressure $p_r$ is too low, the system may be unable to maintain a sufficient mass flow rate of refrigerant fluid through evaporator 32 to adequately cool thermal load 34.

Receiver 14 can optionally include a heater (14*d* shown in FIG. 10), especially useful in embodiments where the gas receiver 12 is not used. The heater can generally be implemented as any of a variety of different conventional heaters, including resistive heaters. In addition, heater can correspond to a device or apparatus that transfers some of the enthalpy of the exhaust from the engine into receiver 14 or a device or apparatus that transfers enthalpy from any other heat source into receiver 14. During cold start-up, controller 72 activates heater to evaporate portion of the refrigerant fluid in receiver 14 and raise the vapor pressure and pressure $p_r$. This allows the system to deliver refrigerant fluid into evaporator 32 at a sufficient mass flow rate. As the refrigerant fluid in receiver 14 warms up, heater can be deactivated by controller 72.

VII. Integration with Directed Energy Systems

The thermal management systems and methods disclosed herein can implemented as part of (or in conjunction with) directed energy systems such as high energy laser systems. Due to their nature, directed energy systems typically present a number of cooling challenges, including certain heat loads for which temperatures are maintained during operation within a relatively narrow range. Examples of such systems include a directed energy system, specifically, a high energy laser system. System includes a bank of one or more laser diodes and an amplifier connected to a power source. During operation, laser diodes generate an output radiation beam that is amplified by amplifier, and directed as output beam onto a target. Generation of high energy output beams can result in the production of significant quantities of heat. Certain laser diodes, however, are relatively temperature sensitive, and the operating temperature of such diodes is regulated within a relatively narrow range of temperatures to ensure efficient operation and avoid thermal damage. Amplifiers are also temperature-sensitively, although typically less sensitive than diodes.

VIII. Hardware and Software Implementations

Controller 72 can generally be implemented as any one of a variety of different electrical or electronic computing or processing devices, and can perform any combination of the various steps discussed above to control various components of the disclosed thermal management systems.

Controller 72 can generally, and optionally, include any one or more of a processor (or multiple processors), a memory, a storage device, and input/output device. Some or all of these components can be interconnected using a system bus. The processor is capable of processing instructions for execution. In some embodiments, the processor can be a single-threaded processor. In certain embodiments, the processor can be is a multi-threaded processor. Typically, the processor is capable of processing instructions stored in the memory or on the storage device to display graphical information for a user interface on the input/output device, and to execute the various monitoring and control functions discussed above. Suitable processors for the systems disclosed herein include both general and special purpose microprocessors, and the sole processor or one of multiple processors of any kind of computer or computing device.

The memory stores information within the system, and can be a computer-readable medium, such as a volatile or non-volatile memory. The storage device can be capable of providing mass storage for the controller 72. In general, the storage device can include any non-transitory tangible media configured to store computer readable instructions. For example, the storage device can include a computer-readable medium and associated components, including: magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. Processors and memory units of the systems disclosed herein can be supplemented by, or incorporated in, ASICs (application-specific integrated circuits).

The input/output device provides input/output operations for controller 72, and can include a keyboard and/or pointing device. In some embodiments, the input/output device includes a display unit for displaying graphical user interfaces and system related information.

The features described herein, including components for performing various measurement, monitoring, control, and communication functions, can be implemented in digital electronic circuitry, or in computer hardware, firmware, or in combinations of them. Methods steps can be implemented in a computer program product tangibly embodied in an information carrier, e.g., in a machine-readable storage device, for execution by a programmable processor (e.g., of controller 72), and features can be performed by a programmable processor executing such a program of instructions to perform any of the steps and functions described above. Computer programs suitable for execution by one or more system processors include a set of instructions that can be used, directly or indirectly, to cause a processor or other computing device executing the instructions to perform certain activities, including the various steps discussed above.

Computer programs suitable for use with the systems and methods disclosed herein can be written in any form of programming language, including compiled or interpreted languages, and can be deployed in any form, including as stand-alone programs or as modules, components, subroutines, or other units suitable for use in a computing environment.

In addition to one or more processors and/or computing components implemented as part of controller 72, the systems disclosed herein can include additional processors and/or computing components within any of the control devices (e.g., first control device 18 and/or second control device 22) and any of the sensors discussed above. Processors and/or computing components of the control devices and sensors, and software programs and instructions that are executed by such processors and/or computing components, can generally have any of the features discussed above in connection with controller 72.

A number of embodiments have been described. Nevertheless, it will be understood that various modifications may be made. Accordingly, other embodiments are within the scope of the following claims.

What is claimed is:

1. A thermal management system, comprising:

an open circuit refrigeration system that has an open circuit refrigerant fluid path, with the open circuit refrigeration system comprising:

a receiver having an outlet, with the receiver configured to store a refrigerant fluid;

a liquid separator having an inlet, a liquid side outlet, and a vapor side outlet;

a pump having an inlet and an outlet, with the inlet of the pump coupled to the liquid side outlet of the liquid separator;

a first evaporator configured to extract heat from a first heat load in proximity to the first evaporator, the first evaporator coupled between the receiver and the inlet of the liquid separator;

a second evaporator configured to extract heat from a second heat load in proximity to the second evaporator, the second evaporator coupled between the liquid side outlet of the liquid separator and the outlet of the pump;

a third evaporator configured to extract heat from a third heat load in proximity to the third evaporator, the third evaporator having an inlet that is coupled to the liquid side outlet of the liquid separator, and the third evaporator having an outlet;

a flow control device coupled between the liquid side outlet and the inlet to the third evaporator;

a first exhaust line coupled to the vapor side outlet of the liquid separator to discharge refrigerant vapor so that the discharged refrigerant vapor is not returned to the open circuit refrigerant fluid path;

a back pressure regulator having an inlet coupled to the outlet of the third evaporator and having an outlet; and a second exhaust line coupled to the outlet of the back pressure regulator to discharge refrigerant vapor so that the discharged refrigerant vapor is not returned to the open circuit refrigerant fluid path.

2. The system of claim 1, wherein the flow control device is a first flow control device, the system further comprising:

a second flow control device.

3. The system of claim 2, wherein the second flow control device is an expansion valve, with the expansion valve having an inlet coupled to the outlet of the receiver and having an outlet coupled to an inlet of a junction device.

4. The system of claim 2, wherein the second flow control device is an expansion valve, with the expansion valve having an inlet coupled an outlet of a junction device and having an outlet that is coupled to the inlet of the first evaporator.

5. The system of claim 1, further comprising:

a sensor device disposed to produce a signal indicative of a thermodynamic property of refrigerant at an outlet of the third evaporator, with the signal disposed to control the flow control device.

6. The system of claim 5, further comprising:

a controller that receives the signal from the sensor device, and produces a control signal to control the flow control device.

7. The system of claim 1, wherein the back pressure regulator is a first back pressure regulator, with the system further comprising:

a second back pressure regulator to control a vapor pressure of refrigerant vapor that exits the vapor side outlet of the liquid separator, and to discharge the refrigerant vapor that exits the vapor side outlet through the first exhaust line, so that the discharged refrigerant is not returned to the open circuit refrigerant fluid path.

8. The system of claim 1, wherein the first and second exhaust lines are both configured to discharge the refrigerant vapor to a common space.

9. The system of claim 1, wherein the first evaporator is configured to maintain a set vapor quality of the refrigerant fluid at an outlet of the evaporator.

10. The system of claim 9, wherein the set vapor quality of the refrigerant fluid at an outlet of the evaporator is in a range of 0.5 to almost 1.

11. The system of claim 1, wherein the flow control device is a first flow control device, the system further comprising:

a second receiver configured to store a gas;

a second flow control device having an inlet coupled to the outlet of the second receiver and having an outlet coupled to an inlet of the first receiver, with the second flow control device configured to receive the gas from the second receiver and feed the gas to the inlet of the first receiver to maintain liquid refrigerant in the first receiver in a subcooled state.

12. The system of claim 11, further comprising:

a third flow control device.

13. The system of claim 12, wherein the third flow control device is an expansion valve, with the expansive valve coupled between the outlet of the receiver and a junction device.

14. The system of claim 12, wherein the third flow control device is an expansion valve, with the expansive valve coupled between a junction device that is coupled to the outlet of the receiver and the inlet of the first evaporator.

15. The system of claim 11, further comprising:

a sensor device disposed to produce a signal indicative of a thermodynamic property of refrigerant at an outlet of the third evaporator, with the signal controlling the first flow control device.

16. The system of claim 15, further comprising:

a controller that receives the signal from the sensor device and produces a control signal to control the first flow control device.

17. The system of claim 15, wherein the back pressure regulator is a first back pressure regulator, with the system further comprising:

a second back pressure regulator controls a vapor pressure of refrigerant vapor exiting the vapor side outlet of the liquid separator and discharges the exiting refrigerant vapor through the first exhaust line.

18. The system of claim 15, wherein the first and second exhaust lines are both configured to discharge the refrigerant vapor to a common space.

19. The system of claim 15, wherein the first evaporator is configured to maintain a set vapor quality of the refrigerant fluid at an outlet of the evaporator.

20. The system of claim 19, wherein the set vapor quality of the refrigerant fluid at an outlet of the evaporator is in a range of 0.5 to almost 1.

21. A thermal management method, comprising:

transporting a refrigerant liquid along an open circuit refrigerant fluid path from a refrigerant receiver;

pumping refrigerant fluid received at an inlet of a pump from an outlet of a liquid separator through a first evaporator disposed in the open circuit refrigerant fluid path, with the first evaporator configured to extract heat from a first heat load in proximity to the first evaporator;

mixing the refrigerant fluid from the refrigerant receiver and the pumped refrigerant fluid received from the liquid separator to provide a mixed of refrigerant fluid;

transporting the mixed refrigerant fluid to a second evaporator that is configured to extract heat from a second heat load that is in proximity to the second evaporator;

transporting refrigerant to an inlet of the liquid separator;

separating by the liquid separator refrigerant vapor from the refrigerant and liquid refrigerant from the refrigerant;

transporting the liquid refrigerant to the pump and to an inlet of a third evaporator, with the third evaporator configured to remove heat from a third heat load that contacts the third evaporator; and discharging at an exhaust circuit, refrigerant at an outlet of the third evaporator so that the discharged refrigerant is not returned to the open circuit refrigerant fluid path.

22. The method of claim 21, wherein the exhaust circuit is a first exhaust circuit, the method further comprises:

discharging at a second exhaust circuit, refrigerant vapor from the liquid separator so that the discharged refrigerant is not returned to the open circuit refrigerant fluid path.

23. The method of claim 21, wherein discharging through the first exhaust circuit and discharging through the second exhaust circuit occur though a first back pressure regulator coupled to the outlet of the third evaporator and an inlet to the first exhaust circuit, and a second back pressure regulator coupled between the vapor side outlet and the second exhaust circuit.

24. The method of claim 23, wherein discharging through the first exhaust circuit and discharging through the second exhaust circuit occur by controlling vapor pressures of vapor by maintaining a set vapor pressure at inlets of the first back pressure regulator and the second back pressure regulator.

25. The method of claim 21, wherein mixing, further comprises:

directing the refrigerant from the receiver and the refrigerant pumped at the outlet of the pump into first and second inlets of a junction device to provide the mixed refrigerant.

26. The method of claim 25, further comprising:

directing the mixed refrigerant into the first evaporator.

27. The method of claim 21, wherein a flow control device is coupled between a liquid side outlet of the liquid separator and the inlet of the third evaporator, with the method further comprising:

measuring a thermodynamic property of refrigerant at an outlet of the third evaporator with at least one sensor device disposed to produce a signal indicative of the measured thermodynamic property, with the signal controlling the flow control device.

28. The method of claim 27, further comprising:

receiving by a controller, the signal from the at least one sensor device; and producing from the signal from the at least one sensor device, a control signal to control the control device.

29. The method of claim 21, wherein a first flow control device is coupled between the refrigerant receiver and the inlet to the first evaporator, with the method further comprising:

transporting a gas from a second receiver to a second flow control device having an inlet coupled to an outlet of the second receiver and having an outlet coupled to an inlet of the first receiver, with the second flow control device configured to receive the gas from the second receiver and feed the gas to the inlet of the first receiver to maintain liquid refrigerant in the first receiver in a subcooled state.

30. The method of claim 21, wherein the first evaporator is configured to maintain a set vapor quality of the refrigerant fluid at an outlet of the first evaporator.

31. The method of claim 30, wherein the set vapor quality of the refrigerant fluid at an outlet of the evaporator is in a range of 0.5 to almost 1.

32. The method of claim 21, wherein the third evaporator operates at a superheat.

33. The method of claim 32, further comprising:

expanding at a constant enthalpy, the refrigerant fluid from the refrigerant receiver in an expansion device disposed in the open circuit refrigerant fluid path into a two phase liquid-vapor refrigerant stream.

34. The method of claim 33, wherein mixing, further comprises:

directing the two phase liquid-vapor refrigerant stream from the receiver and the refrigerant pumped at the outlet of the pump into first and second inlets of a junction device to provide the mixed refrigerant.

35. The method of claim 34, wherein the first evaporator receives the mixed refrigerant directly from an outlet of the junction device.

* * * * *